US005940053A

United States Patent [19]

Ikeda

[11] Patent Number: 5,940,053

[45] Date of Patent: Aug. 17, 1999

[54] CURRENT-DEPENDENT LIGHT-EMITTING ELEMENT DRIVE CIRCUIT FOR USE IN ACTIVE MATRIX DISPLAY DEVICE

[75] Inventor: Naoyasu Ikeda, Tokyo, Japan

[73] Assignee: NEC Corporation, Tokyo, Japan

[21] Appl. No.: 08/941,026

[22] Filed: Sep. 30, 1997

Related U.S. Application Data

[62] Division of application No. 08/512,643, Aug. 8, 1995, Pat. No. 5,714,968.

[30] Foreign Application Priority Data

Aug. 9, 1994 [JP] Japan ..... 6-206078
Aug. 10, 1994 [JP] Japan ..... 6-208185

[51] Int. Cl.[6] ..... G09G 3/30

[52] U.S. Cl. ..... 345/77; 345/76

[58] Field of Search ..... 345/76–78, 80, 345/90–93, 205–206, 211–214; 349/41, 42

[56] References Cited

U.S. PATENT DOCUMENTS 4,393,380 7/1983 Hosokawa et al. ..... 345/90
4,996,523 2/1991 Bell et al. ..... 345/77
5,095,248 3/1992 Sato ..... 345/80
5,235,253 8/1993 Sato ..... 345/79
5,302,966 4/1994 Stewart ..... 345/147
5,576,726 11/1996 Rhyne et al. ..... 345/76
5,670,792 9/1997 Utsugi et al. ..... 345/80

*Primary Examiner*—Amare Mengistu
*Assistant Examiner*—Ricardo Osorio
*Attorney, Agent, or Firm*—Whitham, Curtis & Whitham

[57] ABSTRACT

In a light-emitting element drive circuit in an active matrix display device, at least one current-control transistor controls a current flowing through a light-emitting element are connected in parallel to each other. A constant current source is connected to a junction between one electrode of the light-emitting element and one electrode of the transistor through which the current 8s controlled to flow. The other electrodes of the light-emitting element and the transistor are connected to a common electrode which may be grounded via a resistor. In other configuration, it may be arranged that the light-emitting element and a capacitance are connected in parallel to each other. In this case, the current-control transistor is connected to a junction between the light-emitting element and the capacitance so as to use charging and discharging operations of the capacitance for driving the light-emitting element.

4 Claims, 17 Drawing Sheets

CURRENT-DEPENDENT LIGHT-EMITTING ELEMENT DRIVE CIRCUIT FOR USE IN ACTIVE MATRIX DISPLAY DEVICE

CROSS REFERENCE TO RELATED APPLICATION

This application is a divisional of application Ser. No. 08/512,643 filed Aug. 8, 1995 now U.S. Pat. No. 5,714,968.

BACKGROUND OF THE INVENTION

The present invention relates to an active matrix display device using current-dependent light-emitting elements as pixels at cross points in the matrix form, and in particular, to a current-dependent light-emitting element drive circuit used at each of cross points.

In a conventional active matrix display device, a plurality of first lines or scanning lines extend in parallel with one another and a plurality of second lines or data lines extend perpendicular to the first lines to form a plurality of cross points arranged in a matrix form. A current-dependent light-emitting element drive circuit is connected to one of the first lines and one of the second lines at each of the cross points to form one of the pixels in the display device. The current-dependent light-emitting element drive circuit comprises the current-dependent light-emitting element to be connected to a current source. A current control transistor is coupled to the first and the second lines and is connected in series with the current-dependent light-emitting element. The current control transistor controls current flowing through the current-dependent light-emitting element from the current source in response to selection signals selectively applied to the first and second lines. The current-dependent light-emitting element emits light with an intensity dependent on the current controlled.

As the current-dependent light-emitting elements, organic and inorganic EL (electroluminescence) elements, and LEDs (light-emitting diodes) are used and their luminance is dependent on or controlled by the current flowing in the element.

The display device has been widely used in televisions, portable terminals and the like, wherein the character display is performed on the dot matrix by arranging the light-emitting elements in a matrix array.

It is advantageous that the display does not require the backlighting as opposed to the liquid-crystal display devices, and is large in the angle of visibility.

The display device of the active matrix type performs the static drive by combination of the transistors and the light-emitting elements and is capable of providing high luminance, high contrast, high accuracy and the like as compared with the passive matrix type display which performs the dynamic drive.

Conventional display devices of the active matrix type are disclosed in JP-A-2 148687 and in a paper entitled "DESIGN OF A PROTOTYPE ACTIVE MATRIX CdSe TFT ADDRESSED EL DISPLAY" by J. Vanfleteren et al, Eurodisplay '90, Society for Information Display, pp. 216–219.

However, in the conventional active matrix display device, a transistor is connected to the light emitting element in series and controls the current flowing therethrough. Therefore, the light intensity or luminance of the light-emitting element is also changed in dependence on variation of properties of the transistors. This results in impossibility of correct control of the light intensity emitted.

Further, when the light-emitting element is repeatedly driven at a high frequency by repeatedly scanning the scanning lines in the display device, a user is caused by flickering to be tired to watch the display.

SUMMARY OF THE INVENTION

Therefore, it is an object of the present invention to provide an improved active matrix drive circuit for light-emitting elements.

It is another object of the present invention to provide an active matrix display device having a current-dependent light-emitting element drive circuit which is capable of driving a current-dependent light-emitting element with a stable light intensity in no relation to the variation of properties of a current controlling transistor.

It is another object of the present invention to provide an active matrix display device having a current-dependent light-emitting element drive circuit which is capable of prolonging light emission of a current-dependent light-emitting element with a decreasing intensity even after a current control transistor is turned off to thereby protect a user from uncomfortableness of the light flickering.

It is another object of the present invention to provide an active matrix display device having a current-dependent light-emitting element drive circuit which is capable of driving the current-dependent light-emitting element with a reduced current and voltage.

According to the present invention, an active matrix display device can be obtained which comprises: a plurality of first lines extending in parallel with one another; plurality of second lines extending perpendicular to the first lines to form a plurality of cross points arranged in a matrix form; and a plurality of current-dependent light-emitting element drive circuits, each disposed at each of the cross points and connected to one of the first lines and one of the second lines at each of the cross points to form one of pixels in the display device. Each of the current-dependent light-emitting element drive circuit comprising: constant current supplying means to be connected to a power source for supplying a constant current; the current-dependent light-emitting element connected in series with the constant current supplying means; the switching means connected in parallel with the current-dependent light-emitting element for controlling current flowing through the current-dependent light-emitting element form the constant current supplying means, the switching means being coupled with the first line and the second line and being controlled between an ON and an OFF conditions by selection signals selectively applied to the first and the second lines.

According to an aspect, each of the current-dependent light-emitting element drive circuit further comprises switch control means coupled to the first and the second lines for processing the selection signals from the first and the second lines to produce a switch control signal. The switching means turns on and off dependent on the switching control signal.

According to another aspect, the switching means comprises a plurality of switching elements connected on parallel with one another. Each of the switching elements is selectively turned on and off.

According to another aspect, the switch control means comprises a plurality of switch control elements responsive to the selection signals for producing element control signals as the switch control signal to control the switching elements, respectively.

According to the present invention, another active matrix display device can be obtained which comprises: a plurality of first lines extending in parallel with one another; a plurality of second lines extending perpendicular to the first lines to form a plurality of cross points arranged in a matrix form; and a plurality of current-dependent light-emitting element drive circuits, each disposed at each of the cross points and being connected to one of the first lines and one of the second lines at each of the cross points to form a pixel in the display device. Each of the current-dependent light-emitting element drive circuit comprises: the current-dependent light-emitting element having a first terminal to be connected to an external current supply means and a second terminal, the current-dependent light-emitting element having a second terminal; current control means coupled to the first and the second lines and connected to the second terminal of the current-dependent light-emitting element for controlling current flowing through the current-dependent light-emitting element from the current supplying means in response to selection signals selectively applied to the first and the second lines; and capacitor connected in parallel with the current-dependent light emitting element.

According to another aspect, first terminal of the light-emitting element is connected to a different one of the first lines to be supplied with a current.

According to the present invention, another active matrix display device is obtained which comprises: a plurality of first lines extending in parallel with one another; a plurality of second lines extending perpendicular to the first lines to form a plurality of cross points arranged in a matrix form; and a plurality of current-dependent light-emitting element drive circuits disposed at cross points, each being connected to one of the first lines and one of the second lines at each of the cross points to from a pixel in the display device. The current-dependent light-emitting element drive circuit comprising: the current-dependent light-emitting element having a first terminal to be connected to an external current supply means and a second terminals, the current-dependent light-emitting element having a second terminal; capacitor having a first capacitor terminal connected to the first terminal of the current-dependent light-emitting element, the capacitor having an opposite second terminal; first current control means coupled to the first and the second lines and connected to the second capacitor terminal of the capacitor for controlling current flowing through the capacitor from the current supplying means in response to selection signals selectively applied to the first and the second lines; and second current control means coupled to the second line and connected between the second capacitor terminal of the capacitor and the second terminal of the light emitting element, for supplying a current from the capacitor to the light-emitting diode, when the second current control means is turned on in absence of the selection signal.

DESCRIPTION OF THE PREFERRED EMBODIMENT

Prior to description of preferred embodiments, known active matrix display devices are described for facilitate understanding of the present invention.

Figure 1:
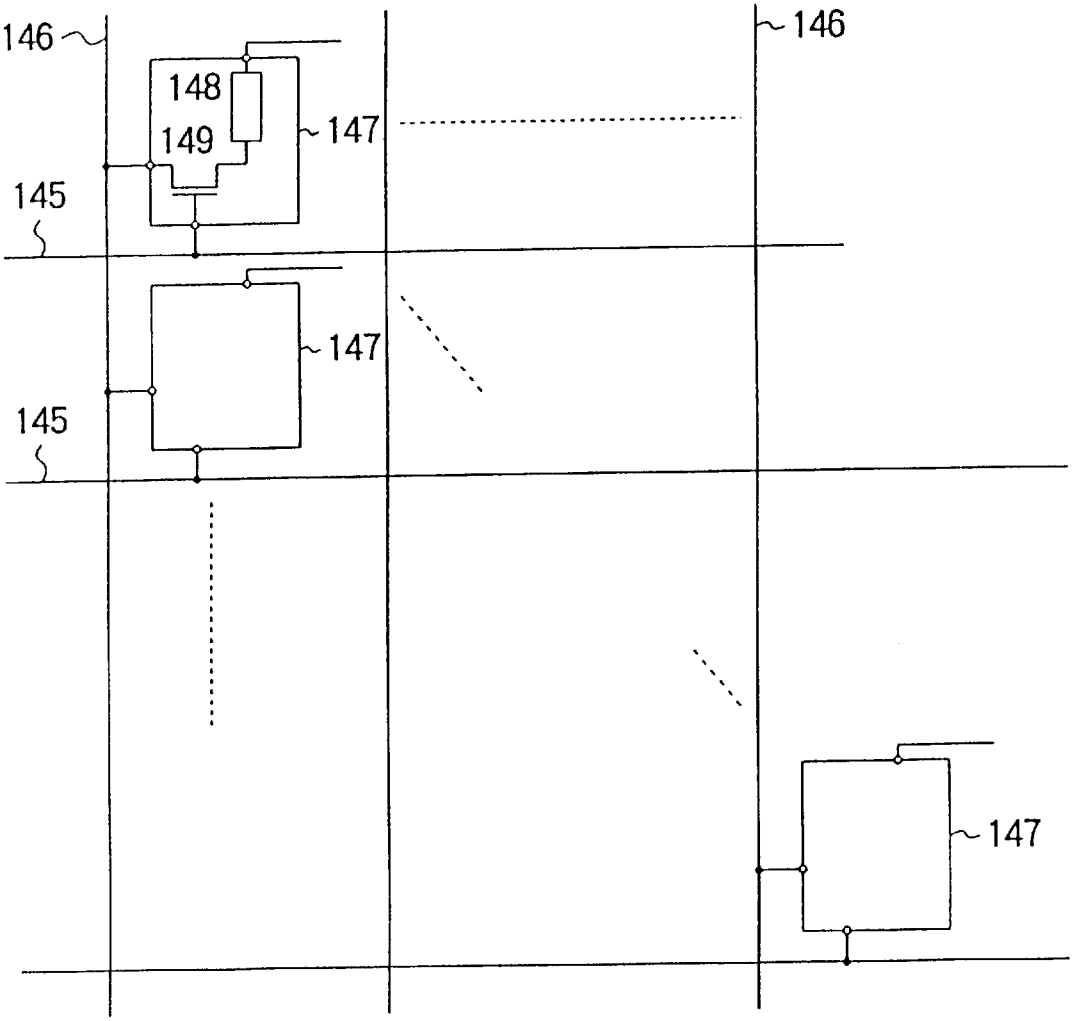
FIG. 1 PRIOR ART
FIG. 1 is a circuit diagram showing a conventional active matrix display device.

Referring to FIG. 1, a conventional active matrix display device shown therein comprises a plurality of first lines or scanning lines 145 extending in parallel with one another and a plurality of second lines or data lines 146 extending perpendicular to the first lines 151 to form a plurality of cross points arranged in a matrix form. A current-dependent light-emitting element drive circuit 147 is connected to one of the first lines 145 and one of the second lines 146 at each of the cross points to form the pixel in the display device.

In the shown example, the current-dependent light-emitting element drive circuit 147 comprises the current-dependent light-emitting element 148 to be connected to a current source (not shown). A current control transistor 149 is coupled to the first and the second lines 145 and 146 and is connected in series with the current-dependent light-emitting element 148 and connected to the second terminal of the current-dependent light-emitting element 148. The current control transistor 149 controls current flowing through the current-dependent light-emitting element 147 from the current source in response to selection signals selectively applied to the first and second lines 145 and 146. The current-dependent light-emitting element 147 emits light with an intensity dependent on the current controlled.

In detail, when the scanning line 145 is selected, the current flows from a data line 146 to a light-emitting element 148 via a transistor 149 so that the light-emitting element 148 emits light. On the other hand, when the scanning line 145 turns into a non-selected state, the transistor 149 turns off to stop the current flow so that the light-emitting element emits no light.

Figure 2:
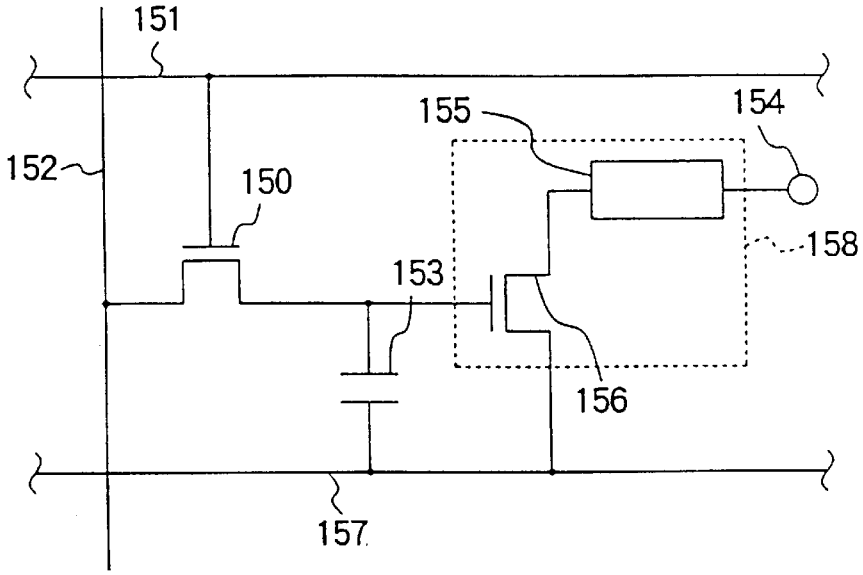
FIG. 2 PRIOR ART
FIG. 2 is a circuit diagram showing another known drive circuit of a light-emitting element.

FIG. 2 shows another known example of the drive circuit of light-emitting element in an active matrix display device which is disclosed in "Eurodisplay '90 " at pages 216 to 219 published by Society for Information Display in 1990. In the disclosed drive circuit of the active matrix display, the EL elements are used as light-emitting elements.

In FIG. 2 when a scanning line 151 connected to the gate of a transistor 150 is selected to be activated, the transistor 150 turns on so that a signal from a data line 152 connected to the transistor 150 is written in a capacitor 153. The capacitor 153 determines the gate-source voltage of a transistor 156.

When the scanning line 151 turns into a non-selected state to turn off the transistor 150, the voltage across the capacitor 153 is held until the scanning line 151 is selected next.

Depending on the voltage across the capacitor 153, the current flows along a route from a source electrode 154, an EL element 155, the drain-source of the transistor 156 and a common electrode 157. This current causes the EL element 155 to emit light.

In general, for performing the animation display in a computer terminal device, the monitor of a personal computer, the television or the like, it is preferable to perform the gradation display which changes luminance of each pixel.

In order to perform the gradation display in the drive circuit of FIG. 2, it is necessary that the voltages around the threshold value be applied between the gate-source electrodes of the transistor 156.

Figure 3:
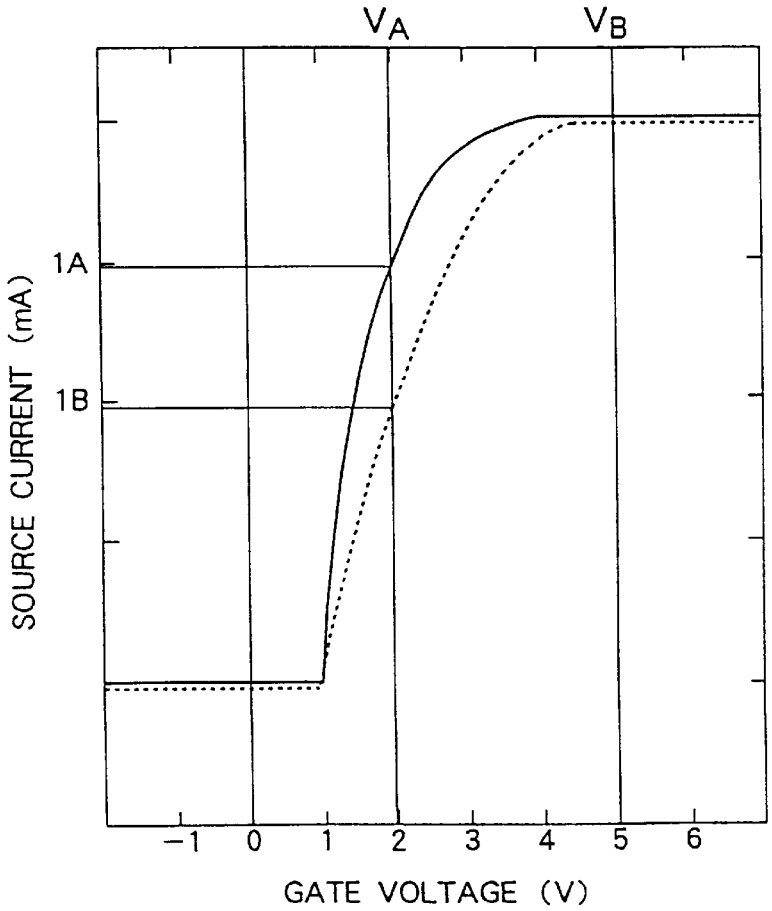
FIG. 3 PRIOR ART
FIG. 3 is a diagram showing a gate voltage to source current relation of a transistor.

However, if the gate voltage-versus-source current characteristic of the transistor 156 has fluctuation as shown by a solid line and a dotted line in FIG. 3, when, for example, a gate voltage VA is applied to the gate of the transistor 156, the current which flows through the transistor 156 differs between IA and IB. Accordingly, the current which flows through the EL element 155 also changes so that luminances of regions, which should have been the same with each other, differ from each other to cause nonuniformity in luminance.

In order to solve this problem, JP-A 2-148687 has proposed the EL display which can perform the gradation display without influence of such fluctuation near the threshold value.

This EL display will be explained with reference to FIG. 4, which shows a portion of the drive circuit corresponding to a current control circuit 158 indicated by a dotted line in FIG. 2. The circuit shown in FIG. 4 includes four data lines for performing the 16-level gradation display.

Figure 4:
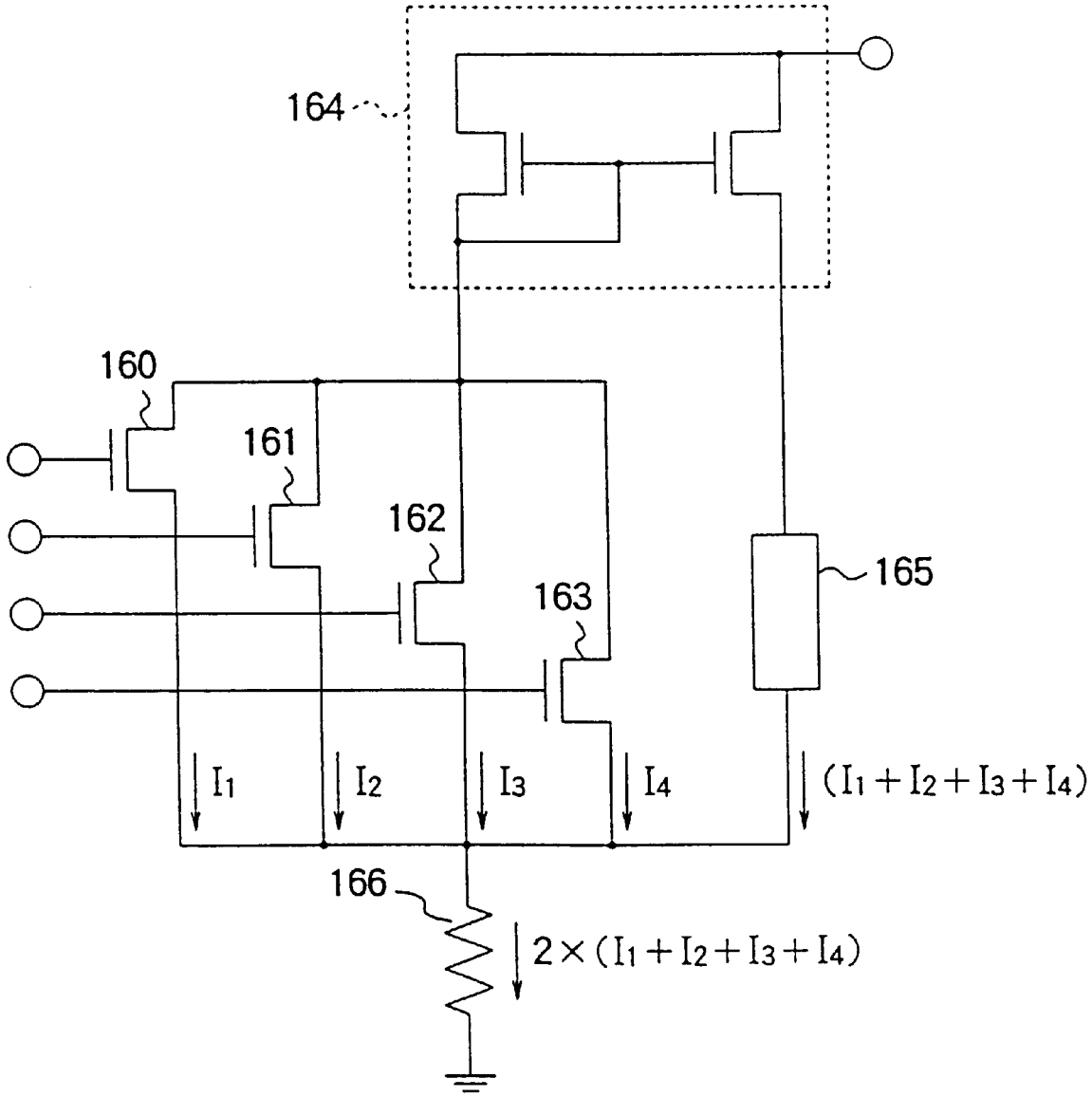
FIG. 4 PRIOR ART
FIG. 4 is a circuit diagram showing another known drive circuit of a light-emitting element.

Referring to FIG. 4, transistors 160–163 are for driving a light-emitting element 165, a current-mirror circuit 164 supplies a current to the light-emitting element 165 and transistors 160-163. A resistance component 166 represents a resistance in a common electrode to which the source electrodes of the transistors 160 to 163 and the light-emitting element 165 are connected. The drain electrodes of the transistors 160 to 163 are commonly connected to each other and further connected to an input end of the current-mirror circuit 164.

In FIG. 4, the signal voltages in combination for the corresponding gradation are inputted to the gates of the transistors 160 to 163 as four-bit data. In this case, a current value equal to the sum of the currents flowing through the transistors which are in the "on" condition or state is supplied to the light-emitting element 165 from an output end of the current-mirror circuit 164 so that the light-emitting element 165 emits light depending on the supplied current value.

For example, by setting logarithmic values of the current values of the transistors 160 to 163 in their "ON" states to be twice in turn, the 16-level gradation display can be performed based on combination of the "On" states of the transistors 160 to 163. In FIG. 4, I1 to I4 represent the source currents of the transistors 160 to 163 when they are turned on, respectively.

By driving the transistor with a voltage corresponding to the gate voltage VB, as shown in FIG. 3, at which the current is saturated, the fluctuation of the characteristic around the threshold value of the transistor causes no influence so that the nonuniformity in luminance is not generated.

However, when the light-emitting element is operated with its maximum luminance in the foregoing drive circuit, the sum of the source currents I1 to I4 and the current (I1+I2+I3+I4) flowing in the current-mirror circuit 164, that is, twice the source currents I1 to I4, flows in the drive circuit.

In this case, half of the sum works for emission of light by the light-emitting element, while the remaining half is consumed at the transistors.

Recently, in the personal computers or the terminals of the work station, the display method is widely available in which, for example, black characters are displayed in the white background on the display screen. When such a display method is performed, the power consumption which does not contribute to the light emission is largely increased.

Further, a common electrode to which the terminals of the transistors 160 to 163 and the light-emitting element 165 are connected at a side opposite to the current-mirror circuit 164, has a resistor 166 which causes a voltage drop when the current flows through the common electrode.

Accordingly, when the luminance is changed, the voltage drop caused at the resistor 166 also changes. Thus, a magnitude of the driving voltage depends on the luminance such that it is small when the luminance is low, while large when the luminance is high.

When a plurality of the drive circuits in the display device are connected to each other, the driving voltage of the transistor may change depending on the luminance of other light-emitting elements.

Further, when the luminance change is large and quick, with the maximum high luminance, and, particularly when the number of pixels is increased, flickering becomes notable to make a user difficult to continue watching the display screen.

Now, preferred embodiments of the present invention will be described hereinbelow with reference to the accompanying drawings.

Figure 5:
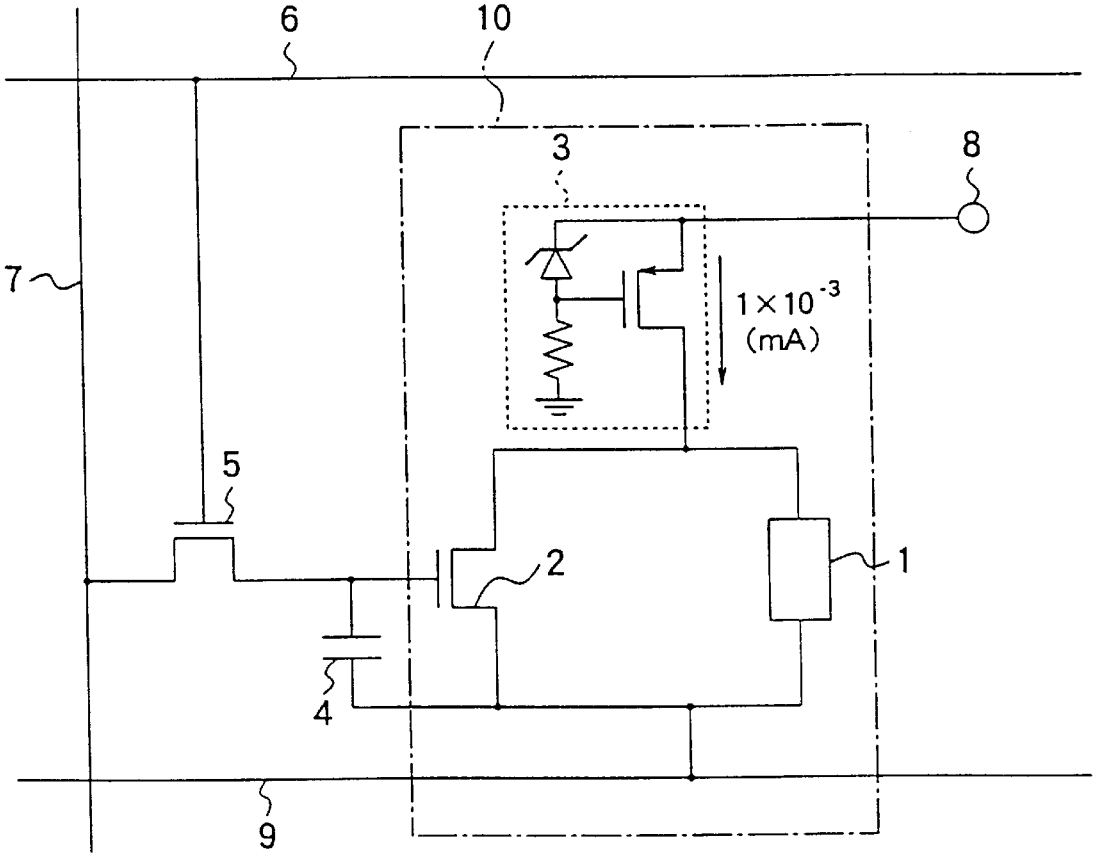
FIG. 5 is a circuit diagram showing a structure of a first embodiment of the present invention.

FIG. 5 shows a portion including a drive circuit of an active matrix display device according to a first embodiment of the present invention. An organic thin-film EL element 1 of a charge-injection type is used as a light-emitting element.

Referring to FIG. 5, a field-effect transistor 2 controls the current flowing therethrough and thus the current flowing through the EL element 1. A constant current circuit or a constant current source 3 supplies a constant current to the EL element 1 and the transistor 2. A capacitor 4 is for determining the gate-source voltage of the transistor 2. Further, a field-effect switching transistor 5 applies, when it is turned on, a signal voltage to the capacitor 4 so as to charge the capacitor 4. A scanning line 6 is for feeding a signal to select the switching transistor 5 to turn it on and a data line 7 is for supplying the current to the capacitor 4 via the switching transistor 5 when it is turned on. A current source electrode 8 is for supplying the current to the constant current circuit 3. A common electrode 9 determines an operating point of the transistor 2 by a potential difference relative to the data line 7.

Figure 6:
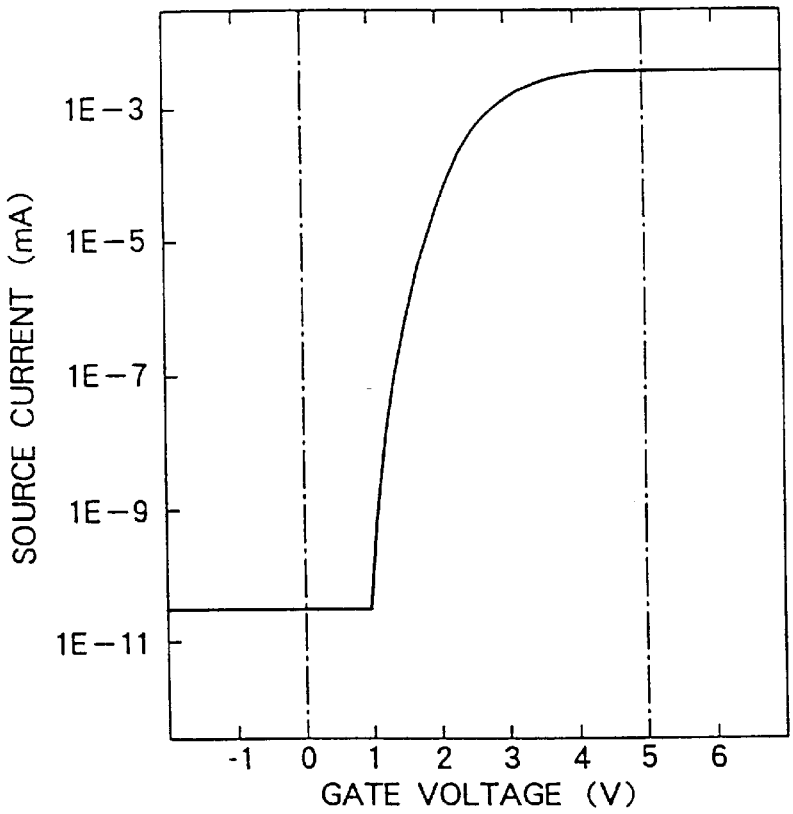
FIG. 6 is a diagram showing an example of a gate voltage-versus-drain current characteristic of a field-effect transistor shown in FIG. 5.
Figure 7:
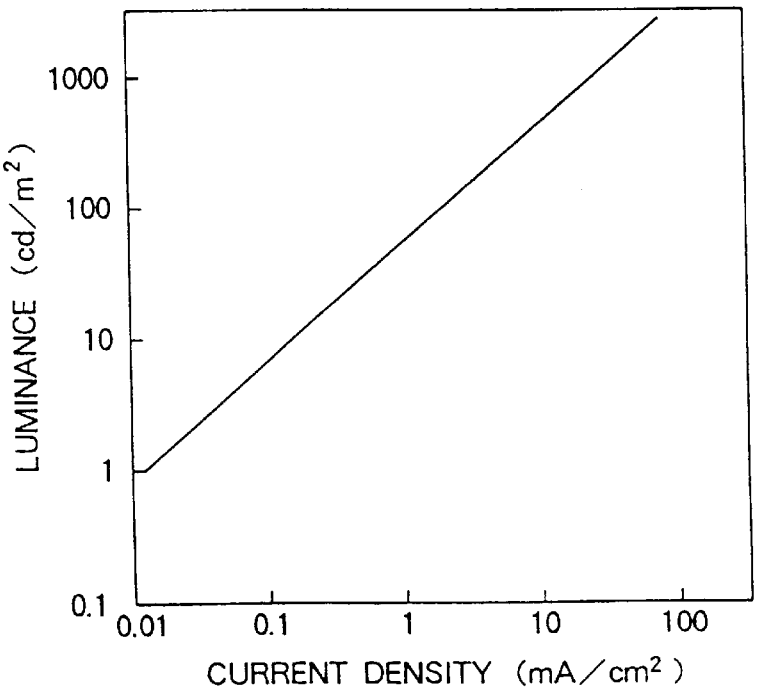
FIG. 7 is a diagram showing an example of a current density-versus-luminance characteristic of an organic thin-film EL element shown in FIG. 5.

It is assumed that a relationship between the gate voltage and the source current of the transistor 2 is as shown in FIG. 6, and the relationship between the current density and the luminance of the EL element 1 is as shown in FIG. 7. In FIG. 6, the axis of ordinate represents a logarithmic scale (unit: mA), and values 1E-3 to 1E-11 represent $1\times10^{-3}$ to $1\times10^{-11}$, respectively.

It is further assumed that the EL element 1 is used in a display for a personal computer having 640 pixels in row and 480 pixels in column and with a diagonal length of 24 cm, and that a pixel size of each EL element 1 is 330 mm×300 mm.

The luminance of the EL element 1 is required to be about 100 (cd/m$^2$) when used in the display. Accordingly, it is seen from FIG. 7 that the current which flows in the EL element 1 is about $1\times10^{-3}$ (mA) at maximum.

In view of the condition noted above, the current which flows in the constant current circuit 3 is set to be $1\times10^{-3}$ (mA).

Now, an operation of the drive circuit according to this embodiment will be described hereinbelow.

When the gate voltage of the transistor 2 is 0 (V), the current which flows through the transistor 2 can be regarded to be substantially 0 (zero) as appreciated from FIG. 6 so that the current from the constant current circuit 3 is all introduced into the EL element 1. In this case, as seen from FIG. 7, the luminance of the EL element 1 becomes about 80 (cl/m$^2$).

On the other hand, when the gate voltage of the transistor 2 is 5 (V), FIG. 6 shows that the current of about $2\times10^{-3}$ (mA) is supposed to flow through the transistor 2. However, since the constant current circuit 3 is connected, the current of $1\times10^{-3}$ (mA) actually flows through the transistor 2. Thus, no current flows to the EL element 1 so that the luminance of the EL element 1 is stopped.

By setting the gate voltage of the transistor 2 to vary between 0 (V) and 5 (V), the luminance of the EL element 1 is adjustable depending on values of the gate voltage of the transistor 2 so that the gradation display can be performed.

Figure 8:
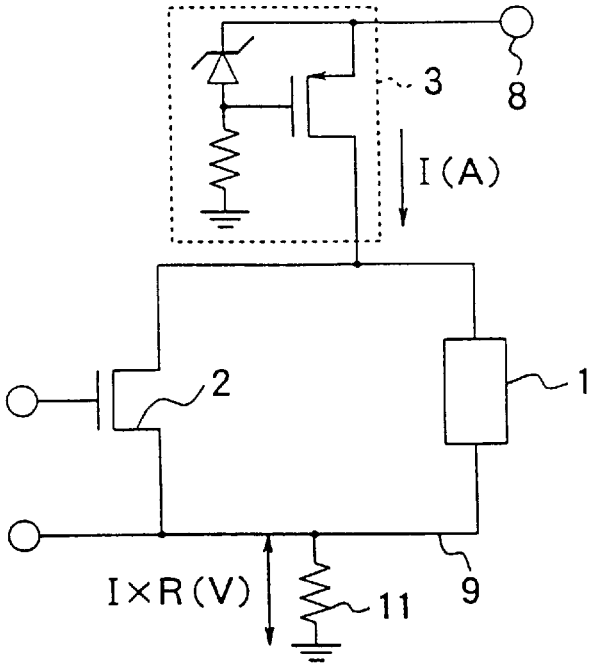
FIG. 8 is a circuit diagram showing a modification of the structure shown in FIG. 5.

FIG. 8 is a circuit diagram showing a modification of the structure shown in FIG. 5, wherein the common electrode 11 is grounded via a resistor 11. As appreciated, the figure only shows a circuit structure corresponding to a current control circuit 10 designated by a long-and-short dash line in FIG. 5. The other structure is the same as that shown in FIG. 5.

In FIG. 8, the same or like components are represented by the same symbols shown in FIG. 5 for omitting further explanation thereof so as to avoid the redundant disclosure.

In FIG. 8, the current flowing through the resistor 11 is constantly equal in amount to the current flowing form the constant current circuit 3 irrespective of whether the transistor 2 is on or off. Accordingly, assuming that he current flowing in the constant current circuit 3 is I(A) and the resistor 11 has a resistance value of R(W), the source voltage of the transistor 2 is higher than the source voltage of transistor 2 of FIG. 1 by I×R(V). Thus, by applying a DC bias voltage of I×R(V) to the voltage on the data line 7 in advance, a gate voltage-versus-luminance characteristic which is the same as that achieved in the structure of FIG. 4 can be obtained in the structure of FIG. 8.

Figure 9:
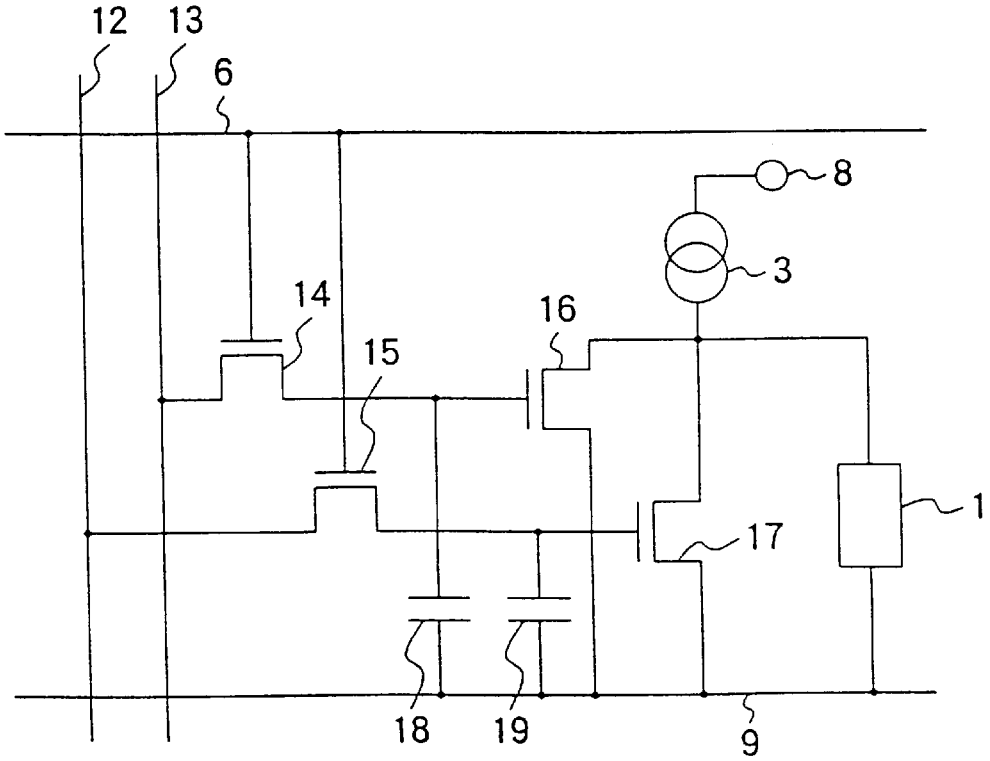
FIG. 9 is a circuit diagram showing another modification of the structure shown in FIG. 5.

FIG. 9 is a circuit diagram showing a further modification of the structure shown in FIG. 5, wherein a plurality of (two in this modification ) field-effect transistors 16 and 17 are provided instead of the transistor 2 to perform the gradation display.

In FIG. 9, the same or like components are represented by the same symbols shown in FIG. 5 for omitting further explanation thereof so as to avoid the redundant disclosure.

In FIG. 9, the transistor 17 for controlling the current passing therethrough is controlled in operation by a first data line 12, a field-effect switching transistor 15 and a capacitor 19. Similarly, the current-control transistor 16 is controlled in operation by a second data line 13, a field-effect switching transistor 14 and a capacitor 18. In order to simplify the figure, the constant current circuit 3 is not shown with its internal circuit, but is identified by a circuit symbol representing the constant current source. The driving method of each of the transistors 16 and 17 is the same as that described above with reference to FIG. 5.

It is assumed that each of the transistors 16 and 17, when fully on, allows the current (the on current) to flow from the drain to the source in amount of about $2\times10^{-3}$ (mA), that the relationship between the gate voltage and the source current of each of the transistors 16 and 17 has the characteristic shown in FIG. 6, and that the constant current circuit 3 feeds a constant current of $4\times10^{-3}$ (mA).

When the voltages on the first data line 12 and the second data line 13 are both 0(V), the current flowing through the transistors 16 and 17 can be regarded to be substantially 0 (zero). Accordingly, as seen from FIG. 7, the luminance of the EL element 1 becomes about 200 (cd/m$^2$).

On the other hand, when the voltage of either one of the data lines 12 and 13 becomes 5 (V), for example, when only the voltage on the first data line 12 becomes 5 (V), the current of about $2\times10^{-3}$ (mA) flows through the transistor 17. Accordingly, the current of $2\times10^{-3}$ (mA) flows through the EL element 1 to cause the luminance of about 100 (cd/m$^2$).

Further, when the voltages on the data lines 12 and 13 both become 5 (V), the current of $4\times10^{-3}$ (mA) in total flows through the transistors 16 and 17. Accordingly, no current flows through the EL element 1 so that the EL element 1 produces no luminance.

As described above, by changing the combination of the on/off states of the transistors 16 and 17, the gradation display can be performed using the EL element 1.

In the foregoing latter modification, the on current of the transistor 16 and that of the transistor 17 are equal in amount to each other. However, the present invention is not limited thereto. For example, if the on current values of the transistors 16 and 17 are set to be different from each other, the gradation of four levels can be achieved, that is, the level where the transistors 16 and 17 are both on, the level where the transistors 16 and 17 are both off, the level where only the transistor 16 is on, and the level where only the transistor 17 is on.

Further, in the foregoing latter modification, the two transistors 16 and 17 are used. However, the present invention is not limited thereto, and more than two transistors may be used to increase the number of the gradation levels.

Further, in the foregoing first embodiment and its modifications, the organic thin-film EL element 1 is used. However, the present invention is not limited thereto. For example, a light-emitting element, such as, an inorganic EL element or an LED, whose luminance is determined by a value of the current, may be used instead of the organic thin-film EL element 1.

Further, in the foregoing first embodiment and its modification, each of the transistors 2, 16 and 17 in an n-channel field-effect transistor. However, the present invention is not limited thereto. For example, a p-channel field-effect transistor, a bipolar junction transistor or the like may be used instead of the n-channel field-effect transistor. Similarly, although the constant current circuit 3 is constituted by the p-channel field-effect transistor, the present invention is not limited thereto.

Now, referring to FIG. 10, a second embodiment of the present invention will be described hereinbelow. FIG. 6 shows an active matrix display device including adjacent two drive circuits with pixels arranged in a matrix formed by scanning lines and data lines.

Figure 10:
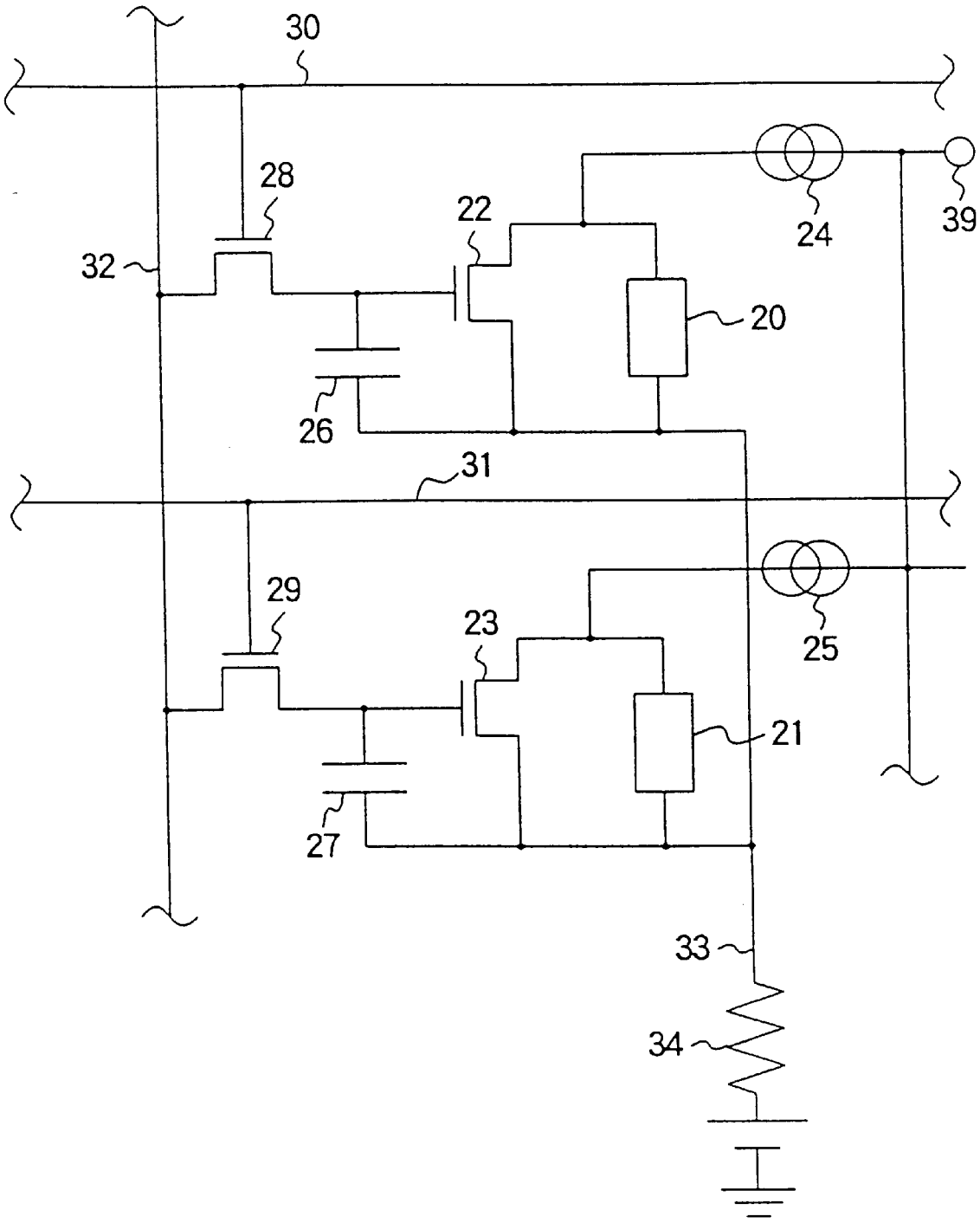
FIG. 10 is a circuit diagram showing a structure of a second embodiment of the present invention.

In FIG. 10, organic thin-film EL elements 20 and 21 are used as current-dependent light-emitting elements, forming the pixels. Field-effect transistors 22 and 23 controls the currents of the EL elements 20 and 21, respectively, and constant current circuits 24 and 25, respectively. Reference numerals 26 and 27 denote capacitors, respectively, numerals 28 and 29 switching transistors, respectively, numerals 30 and 31 scanning lines, respectively, numeral 32 a data line, numeral 33 a common electrode, numeral 34 a resistor, i.e. a resistance component of the common electrode 34, and numeral 39 a source electrode.

Assuming that a current value of each of the constant current circuits 24 and 25 is I(A), the current which flows through the resistor 34 is constant at 2×I(A) regardless of values of the currents flowing through the EL elements 20 and 21, respectively. In this case, if a resistance value of the resistor 34 is R(W), the voltage drop across the resistor 34 is constant at 2×I×R(V), meaning that the values of the currents flowing through the EL elements 20 and 21 have no influence upon a magnitude of the voltage drop across the resistor 34.

This shows that the potential at the common electrode 33 and thus the source voltage of the transistors 22 and 23 are held constant regardless of the current values at the EL elements 20 and 21. Accordingly, by applying a DC bias voltage 2×I×R(V) R(V) to the voltage on the data line 32 in advance, it is possible to control the luminance of the EL elements 20 and 21 without influence from other circuit elements.

As appreciated, although only the two pixels with the corresponding drive circuits are shown in FIG. 10 for simplifying the explanation, the present invention is not limited thereto but also covers a structure where more than two pixels with the corresponding drive circuits are arranged in a matrix array.

Further, in the foregoing second embodiment, only one transistor is connected in parallel to the EL element for controlling the operation thereof. However, a plurality of the transistors may be arranged to control the operation of one light-emitting element line in the foregoing latter modification of the first embodiment.

As described above, according to the foregoing preferred embodiments and modifications, during the maximum luminance of the light-emitting element, the current essentially only flows through the light-emitting means from the constant current source. Accordingly, the current consumption in the drive circuit can be largely reduced as compared with the afore-mentioned prior art where the on current equal in amount to the current flowing through the light-emitting element also flows through the current-control transistors.

Further, since the current consumption in the drive circuit can be suppressed, if a plurality of such drive circuits are arranged in an array so as to display, for example, black characters in the white background on the display screen, the current consumption in the circuit array can be greatly reduced as compared with the prior art.

Further, since the maximum current flowing at the common electrode can be diminished as compared with the prior art, the increment of the driving voltage due to the voltage drop caused by the resistance component of the common electrode can be suppressed.

Further, since the voltage drop at the common electrode is held constant regardless of the luminance of the light-emitting element, correction or adjustment of the driving voltage can be facilitated.

Now, referring to FIG. 11, a third embodiment of the present invention will be described hereinbelow.

Figure 11:
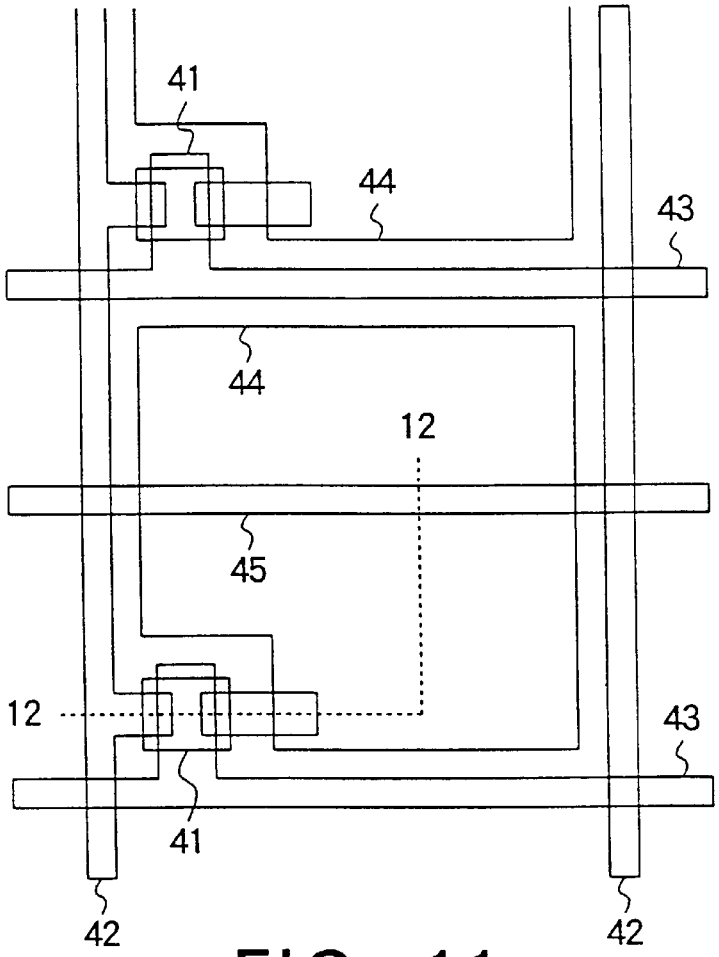
FIG. 11 is a plan view showing a structure of a third embodiment of the present invention.

FIG. 11 is a plan view showing an active matrix drive circuit according to the third embodiment of the present invention. In FIG. 11, reference numeral 41 denotes an amorphous silicon thin-film field-effect transistor (hereinafter referred to as "TFT") of a reverse-stagger structure as a driving transistor, numeral 42 a data line, numeral 43 a scanning line, numeral 44 an electron-injection electrode, numeral 45 a capacitance line for forming capacitance relative to the electron-injection electrode 44.

Figure 12:
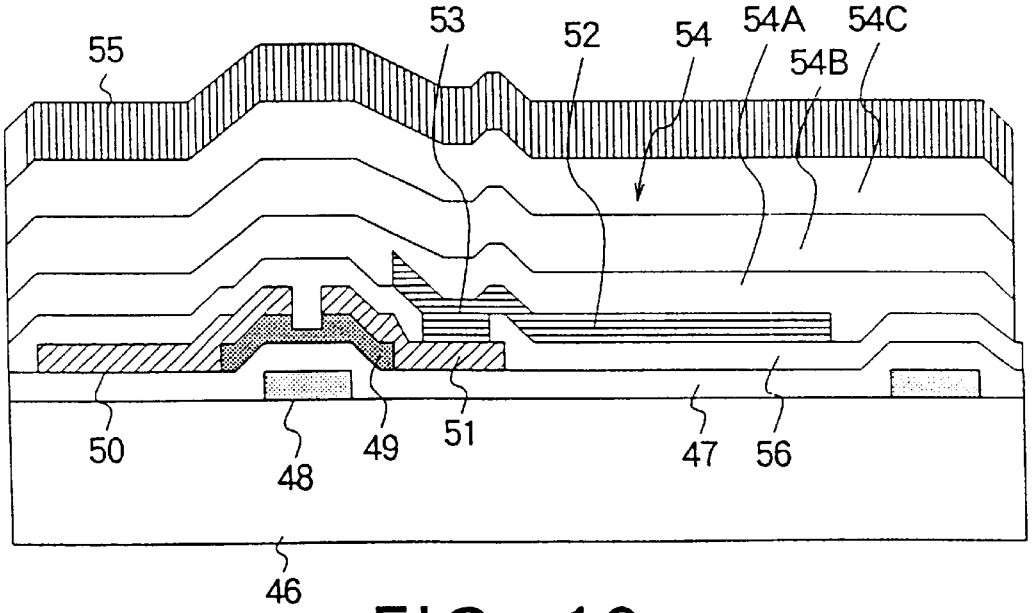
FIG. 12 is a sectional view taken along line 12—12 in FIG. 11.

FIG. 12 is a sectional view taken along line 12—12 in FIG. 11, In FIG. 12, numeral 46 denotes a transparent glass substrate, numeral 47 a gate insulating film numeral 48 a gate electrode of the TFT 41, numeral 49 an island of the TFT 41, numeral 50 a source electrode of the TFT 41, and numeral 51 a drain electrode of the TFT 41. Further, in FIG. 12, numeral 52 denotes an electron-injection electrode formed of MgAg, numeral 53 a contact hole, numeral 54 organic thin-film layers composed of a spacer layer 54A, an organic luminescent layer 54B and a hole-injection layer 54C and forming an organic thin-film EL element of a charge-injection type as a light-emitting element, numeral 55 a hole-injection electrode formed of ITO (indium-tin-oxide) for guiding out light, and numeral 56 a light-emitting element insulating film.

Hereinbelow, a process for fabricating a display for a personal computer according to this embodiment will be described with reference to FIG. 12.

First, a Cr layer is deposited on the glass substrate 46 to a thickness of 200 nm, then the scanning lines 43, the capacitance lines 45 and the gate electrodes 48 of the TFTs 41 are pattern-formed, and thereafter, an $SiO_2$ layer is deposited thereon to a thickness of 440 nm as the gate insulating film 47.

Subsequently, on the gate insulating film 47, a layer of intrinsic amorphous silicon (i-a-Si) for the islands 49 and a layer of $n^+$ amorphous silicon ($n^+$-a-Si) for the ohmic contact are deposited to thicknesses of 300 nm and 50 nm, respectively, and then the island 49 are pattern-formed. On the islands 49, channels of the TFTs 41 are formed later.

Subsequently, a layer of Cr is deposited to a thickness of 100 nm, and then the data lines 42, the source electrodes 50 of the TFTs 41 and the drain electrodes 51 are pattern-formed.

Further, the channel of each of the TFTs 41 is formed by etching the layer of $n^+$ amorphous silicon ($n^+$-a-si) of the island 49 and further etching the layer of intrinsic amorphous silicon (i-a-Si) of the island 49 to a certain depth, using the Cr layer for the source electrode 50 and the drain electrode 51 as a mask.

Subsequently, a layer of $SiO_2$ for the light-emitting insulating films 56 is deposited to a thickness of 200 nm, and the contact holes 53 are formed by etching for connection between the drain electrodes 51 and the later-formed electron-injection electrodes each being one of the electrodes of each of the EL elements.

Thereafter, a layer of MgAg is deposited to a thickness of 200 nm, and then the election-injection electrodes 52 are pattern-formed by the lift-off method.

In this manner, a TFT panel for 640 pixels in row and 480 pixels in column with each pixel having a size of 300×300 nm is prepared.

Thereafter, the organic thin-film EL elements are formed on the TFT panel.

In this embodiment, each EL element has the organic thin-film layers in a three-layered structure including, from the side of the electron-injection electrode 52, the spacer layer 54A for preventing dissociation of excitons on the surface of the electrode 52, the organic luminescent layer 54B and the hole-injection layer 54C which are stacked in the order named. First, a layer of tris (8-hydroxyquinoline) aluminum of 50 nm in thickness is formed as the spacer layer 54A, using the method of vacuum deposition. Then, as the organic luminescent layer 54B, a layer of tris (8-hydroxyquinoline) aluminum of 70 nm in thickness and a layer of 3, 9- perylene dicarboxylic acid diphenylester of 70 nm in thickness are formed by the method of co-deposition from the separate evaporation sources. Further, as the hole-injection layer 54C, a layer of 1, 1-bis-(4-N, N-ditolylaminophenyl) cyclohexane of 50 nm in thickness is formed using the method of vacuum deposition. Finally, as the hole-injection electrode 55, a layer of ITO, i.e. a transparent electrode material, of 1 mm in thickness is formed by the application method.

Now, a relationship of voltages applied to the lines and components in the drive circuit having the structure shown in FIGS. 11 and 12 will be described hereinbelow.

Figure 13:
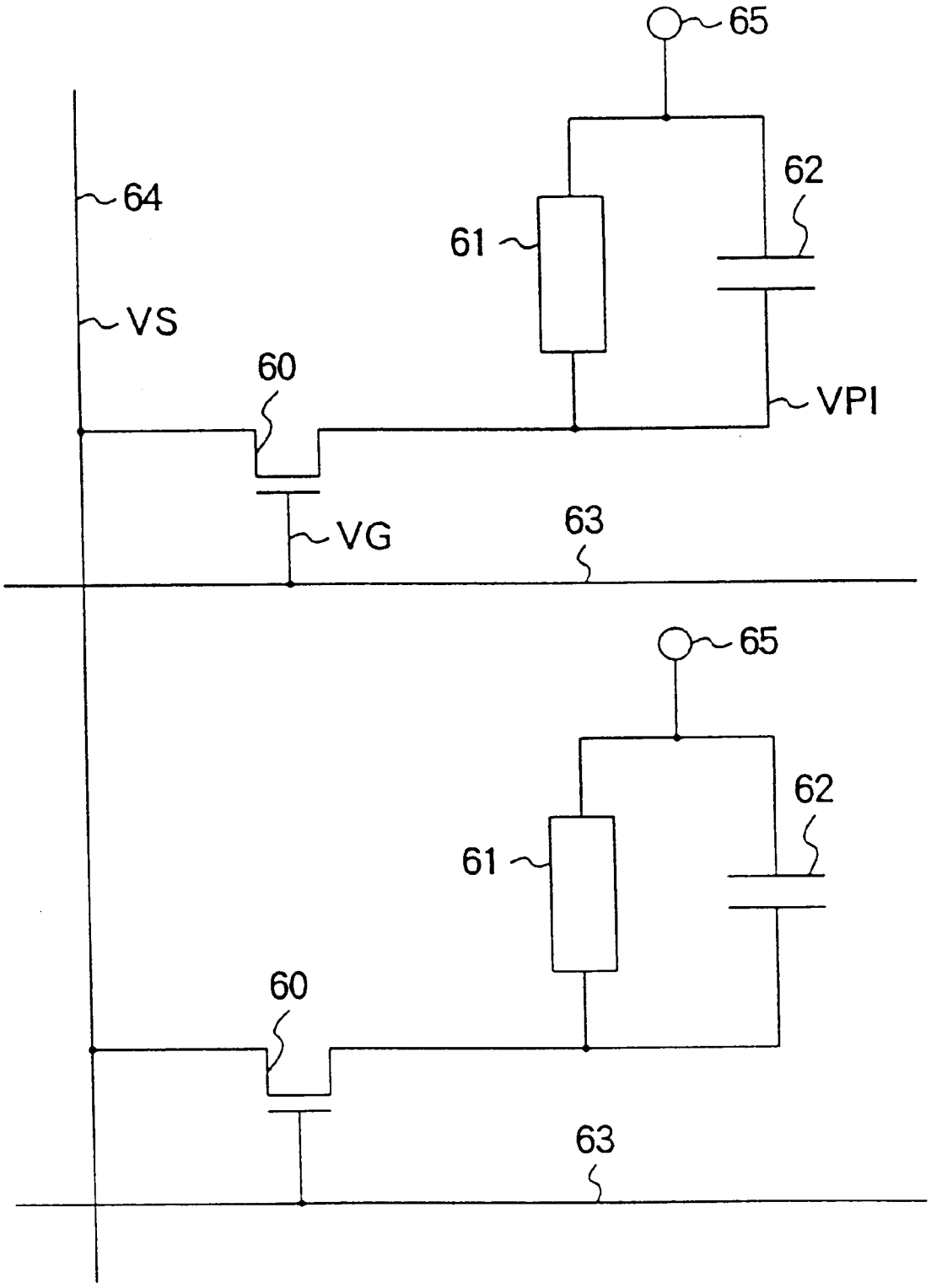
FIG. 13 is a diagram showing an equivalent circuit of the structure shown in FIGS. 11 and 12.

FIG. 13 is a diagram showing an equivalent circuit of the drive circuit shown in FIGS. 11 and 12. In FIG. 13, numeral 60 denotes a TFT, numeral 61 an organic thin-film EL element, numeral 62 a capacitance connected in parallel to the EL element 61, numeral 65 a source electrode for supplying the current to the EL element 61, numeral 63 a scanning line for feeding a signal to select the TFT 60 so as to turn it on, and numeral 64 a data line for supplying the current to the EL element 61 and the capacitance 62 via the TFT 60 when it is on. As shown in FIG. 13, one electrode of the EL element 61 not connected to the TFT 60 and one electrode of the capacitance 62 not connected to the TFT 60 are commonly connected to the source electrode 65.

In FIG. 13, VG, VS and VPI represent voltages on those points in the circuit. Specifically, VG represents a voltage on the gate electrode, VS represent a voltage on the data line 64, and VPI represents a voltage on the electrodes of the EL element 61 and the capacitance 62 which are connected to the TFT 60.

Figure 14A:
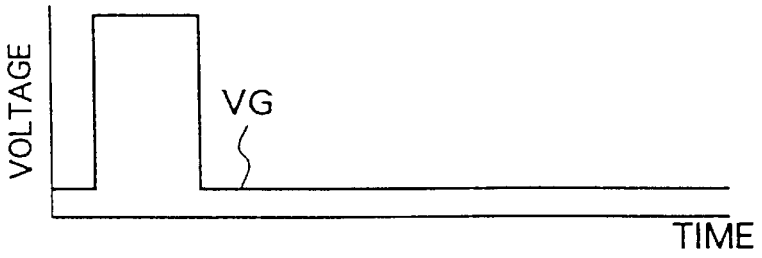
FIGS. 14A to 14C are diagrams, respectively, showing signal waveforms representing voltages on selected points in the circuit of FIG. 13.
Figure 14B:
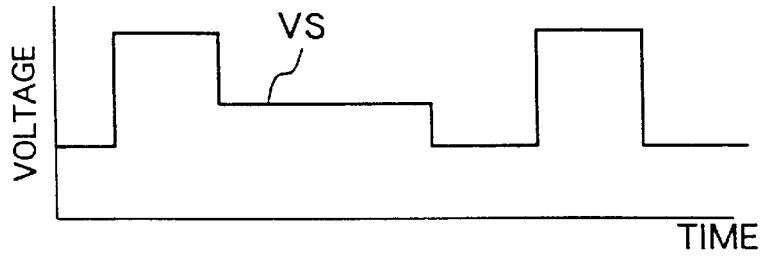
Figure 14C:
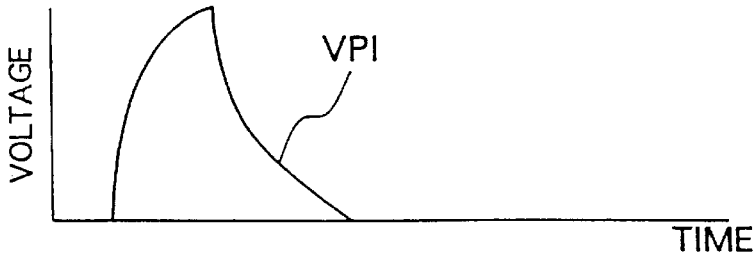

FIGS. 14A to 14C respectively show signal waveforms showing the voltages VG, VS and VPI, and FIG. 10D shows luminance variations with and without the capacitance, 62, wherein LA shows the luminance variation with the capacitance 62 while the EL element 61 emits light due to the voltage VPI, and LB shows the luminance variation without the capacitance 62.

In FIG. 13, when the scanning line 63 is selected to feed the signal to turn on the TFT 60, the voltage is applied from the data line 64 to the EL element 61 and the capacitance 62. Accordingly, the EL element 61 is activated to emit light, and simultaneously, the capacitance 62 is charged.

On the other hand, when the scanning line turns into a non-selected state so that the signal is not fed to the TFT 60, the TFT 60 turns off so that the voltage on the data line 64 is not applied to the EL element 61. However, since the capacitance 62 is loaded with the charges, the EL element 61 continues to emit light for a while due to discharging by the capacitance 62.

Figure 14D:
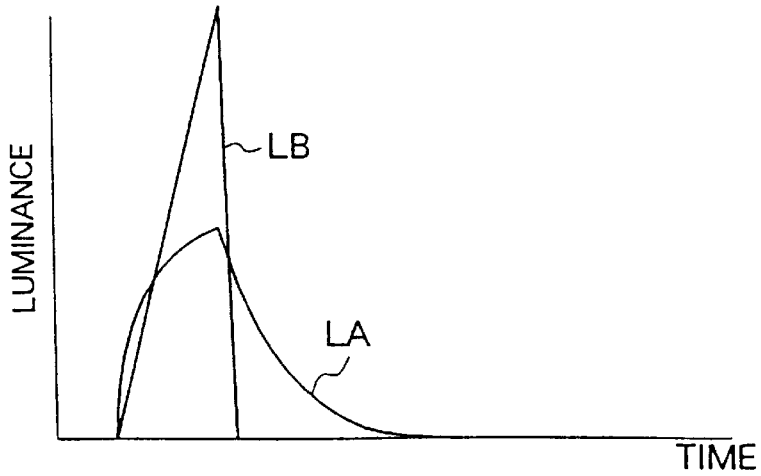
FIG. 14D is a diagram showing luminance variations with and without a capacitance connected in parallel to a light-emitting element.

Accordingly, as seen from LA in FIG. 14D, due to the charging and discharging operations of the capacitance 62, the luminance gradually increases and decreases and the maximum luminance is effectively suppressed, as compared with LB in FIG. 14D. Thus, in case of LB, since a luminance change is large and quick, when the number of the pixels is increased, flickering becomes notable. On the other hand, in case of LA, since a luminance change is small and gradual, flickering is effectively suppressed.

Further, in case of achieving a given luminance, the voltage for the maximum luminance of the light-emitting element can be suppressed. Accordingly, the driving voltage is lowered as compared with the conventional display so that it is possible to provide the display with reduced power consumption. Further, since the power consumption is reduced, the inexpensive low-voltage proof driver IC may be used in the display so that the manufacturing cost of the display can be lowered.

In this embodiment, the light from the light-emitting element is guided out from an upper side relative to the substrate. However, the present invention is not limited thereto. For example, it may be arranged that the electrode near the substrate is formed of a transparent material, such as, ITO, so as to guide out the light from a side where such a transparent electrode is formed.

Further, in this embodiment, the transistor is the amorphous silicon thin-film field-effect transistor of a reverse-stagger type. However, the transistor may be polycrystalline or monocrystalline silicon, compound semiconductor, such as, CdSe, or the like.

Now, referring to FIG. 15, a fourth embodiment of the present invention will be described hereinbelow.

Figure 15:
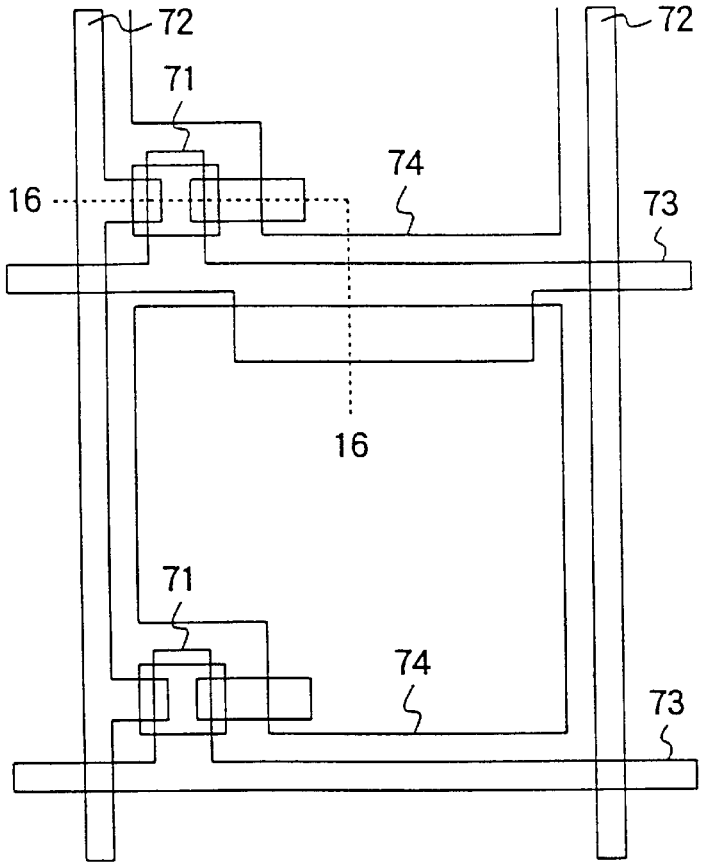
FIG. 15 is a plan view showing a structure of a third embodiment of the present invention.

FIG. 15 is a plan view showing an active matrix drive circuit according to the fourth embodiment of the present invention. In FIG. 15, numeral 71 denotes an amorphous silicon thin-film field-effect transistor of a reverse-stagger structure as a driving transistor (hereinafter referred to as "TFT"), numeral 72 a data line, numeral 73 a scanning line, numeral 74 an electron-injection electrode, numeral 70 a capacitance formed between the electron-injection electrode 74 and the scanning line 73 which is a one-line prior scanning line.

Figure 16:
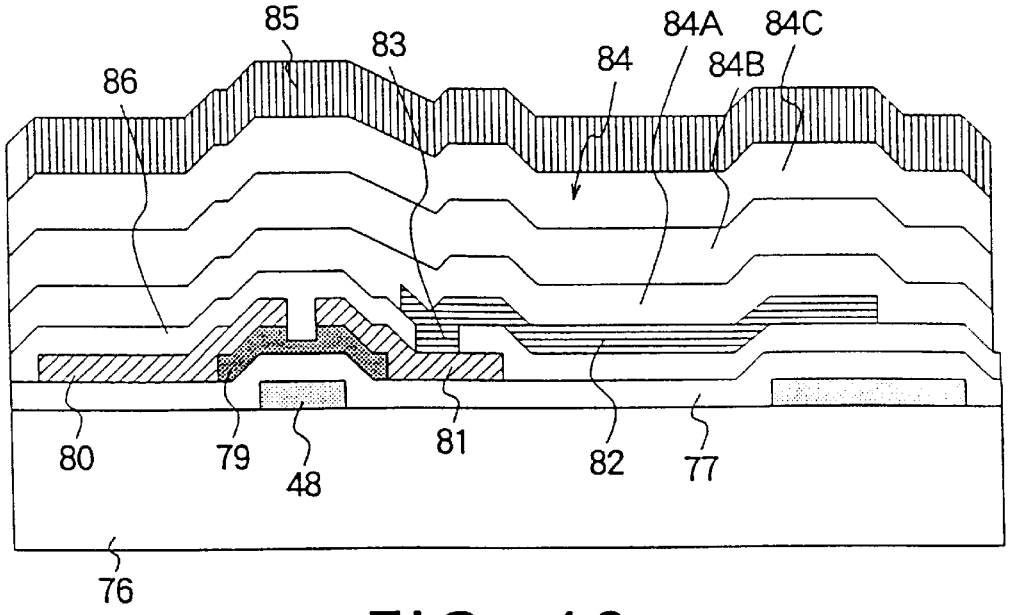
FIG. 16 is a sectional view taken along line 16—16 in FIG. 11.

FIG. 16 is a sectional view taken along line 16—16 in FIG. 15. In FIG. 16, numeral 76 denotes a transparent glass substrate, numeral 77 a gate insulating film numeral 78 a gate electrode of the TFT 71, numeral 79 an island of the TFT 71, numeral 80 a source electrode of the TFT 71, and numeral 81 a drain electrode of the TFT 71. Further, in FIG. 16, numeral 82 denotes an electron-injection electrode formed of MgAg, numeral 83 a contact hole, numeral 84 organic thin-film layers composed of a spacer layer 84A, an organic luminescent layer 84B and a hole-injection layer 84C and forming an organic thin-film EL element of a charge-injection type as a light-emitting element, numeral 85 a hole-injection electrode formed of ITO for guiding out light, and numeral 86 a light-emitting element insulating film.

Hereinbelow, a process for fabricating a display for a personal computer according to this embodiment will be described with reference to FIG. 16.

First, a Cr layer is deposited on the glass substrate 76 to a thickness of 20 nm, then the scanning lines 73, the capacitances 70 connected to the scanning lines 73 and the gate electrodes 78 of the TFTs 71 are pattern-formed, and thereafter, an $SiO_2$ layer is deposited thereon to a thickness of 400 nm as the gate insulating film 77.

Subsequently, on the gate insulating film 77, a layer of intrinsic amorphous silicon (i-a-Si) for the islands 79 and a layer of $n^+$amorphous silicon ($n^{30}$-a-Si) for the ohmic contact are deposited to thicknesses of 300 nm and 50 nm, respectively, and then the island 79 are pattern-formed. On the islands 79, channels of the TFTs 71 are formed later.

Subsequently, layer of Cr is deposited to a thickness of 100 nm, and then the data lines 72, the source electrodes 80 of the TFTs 71 and the drain electrodes 81 are pattern-formed.

Further, the channel of each of the TFTs 71 is formed by etching the layer of $n^+$ amorphous silicon ($n^+$-a-Si) of the island 79 and further etching the layer of intrinsic amorphous silicon (i-a-Si) of the island 79 to a certain depth, using the Cr layer for the source electrode 80 and the drain electrode 81 as a mask.

Subsequently, a layer of $SiO_2$ for the light-emitting insulating films 86 is deposited to a thickness of 200 nm, and the contact holes 83 are formed by etching for connection between the drain electrodes 81 and the later-formed electron-injection electrodes each being one of the electrodes of each of the EL elements.

Thereafter, a layer of MgAg is deposited to a thickness of 200 nm and then the electron-injection electrodes 82 are pattern-formed by the lift-off method.

In this manner, a TFT panel for 640 pixels in row and 480 pixels in column with each pixel having a size of 300×300 mm is prepared.

Thereafter, the organic thin-film EL elements are formed on the TFT Panel.

In this embodiment, each EL element has the organic thin-film layers in a three-layered structure including, from the side of the electron-injection electrode 82, the spacer layer 84A for preventing dissociation of excitons on the surface of the electrode 82, the organic luminescent layer 84B and the hole-injection layer 84C which are stacked in the order named. First, a layer of tris (8-hydroxyquinoline) aluminum of 50 nm in thickness is formed as the spacer layer 84A, using the method of vacuum deposition. Then, as the organic luminescent layer 84B, a layer of tris (8-hydroxyquinoline) aluminum of 70 nm in thickness and a layer of 3, 9-perylene dicarboxylic acid diphenylester of 70 nm in thickness are formed by the method of co-deposition from the separate evaporation sources. Further, as the hole-injection layer 84C, a layer of 1, 1-bis-(4-N, N-ditolylaminophenyl) cyclohexane of 50 nm in thickness is formed using the method of vacuum deposition. Finally, as the hole-injection electrode 85, a layer of ITO, i.e. a transparent electrode material, of 1 mm in thickness is formed by the application method.

Now, a relationship of voltages applied to the lines and components in the drive circuit having the structure shown in FIGS. 15 and 16 will be described hereinbelow.

Figure 17:
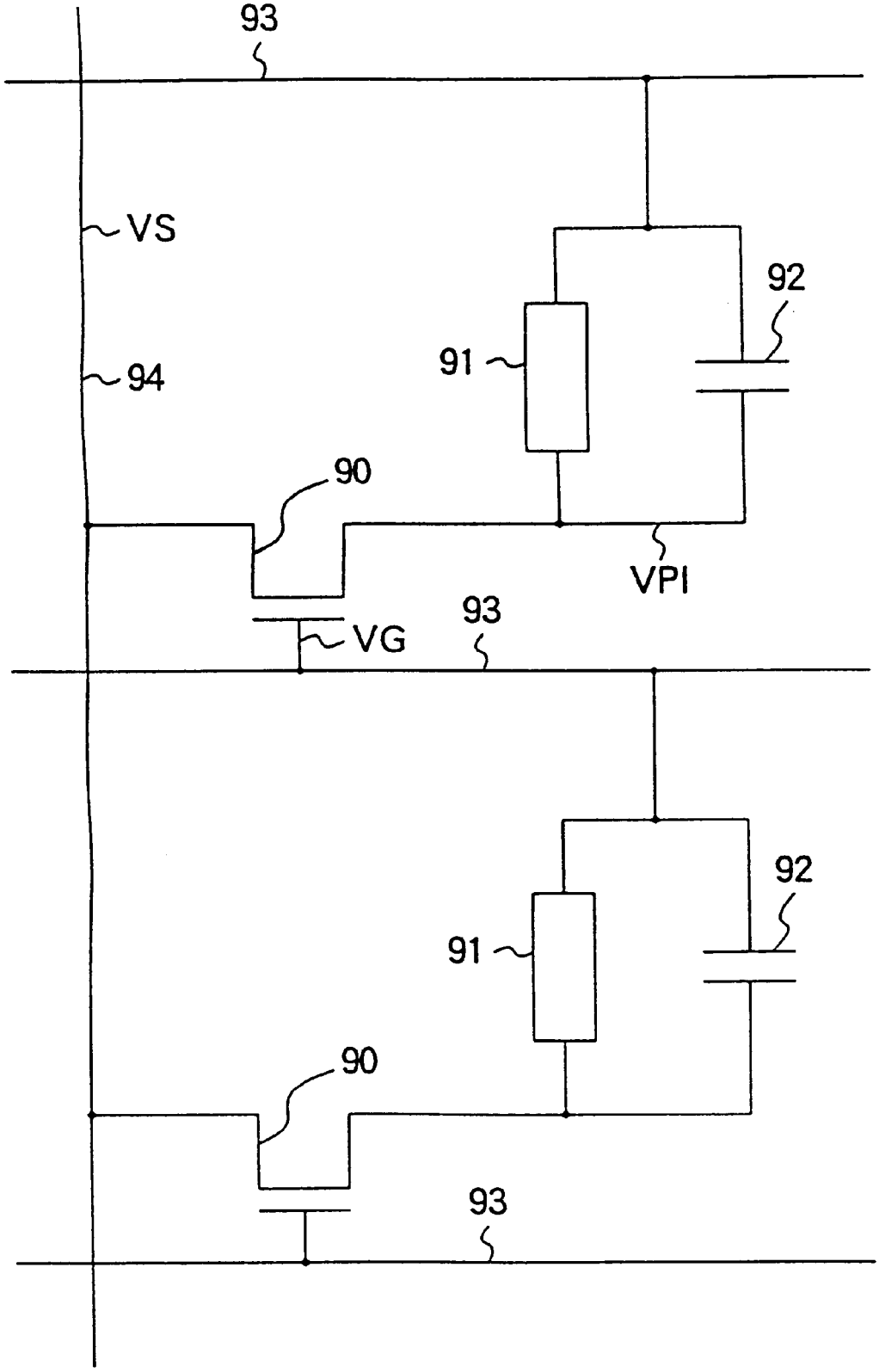
FIG. 17 is a diagram showing an equivalent circuit of the structure shown in FIGS. 11 and 12.

FIG. 17 is a diagram showing an equivalent circuit of the drive circuit shown in FIGS. 15 and 16. In FIG. 17, numeral 90 denotes a TFT, numeral 91 an organic thin-film EL element, numeral 92 a capacitance connected in parallel to the EL element 91, numeral 93 a scanning line for feeding a signal to select the TFT 90 so as to turn it on, and numeral 94 a data line for supplying the current to the EL element 91 and the capacitance 92 via the TFT 90 when it is on. As shown in FIG. 17, one electrode of the EL element 91 not connected to the TFT 90 and one electrode of the capacitance 92 not connected to the TFT 90 are commonly connected to the scanning line 93 which is adjacent to the scanning line 93 connected to the gate of the TFT 90 for allowing the current from the data line 94 to the EL element 91 and the capacitance 92 concerned.

In FIG. 17, VG, VS and VPI represent voltages on those points in the circuit. Specifically, VG represents a voltage on the gate electrode, VS represents a voltage on the data line 94, and VPI represents a voltage on the electrodes of the EL Element 91 and the capacitance 92 which are connected to the TFT 90.

Figure 18A:
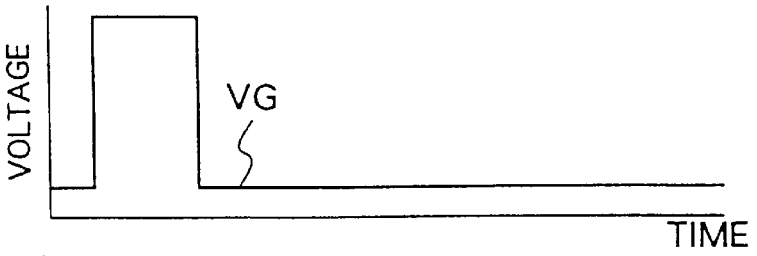
FIGS. 18A to 18C are diagrams, respectively, showing signal waveforms representing voltages on selected points in the circuit of FIG. 17.
Figure 18B:
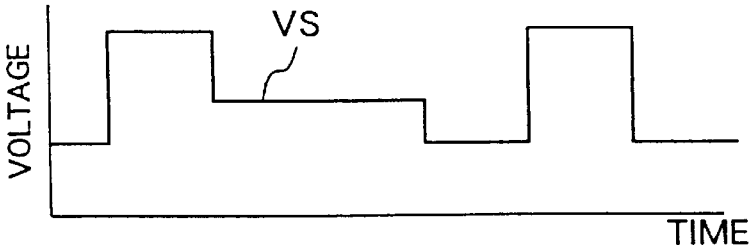
Figure 18C:
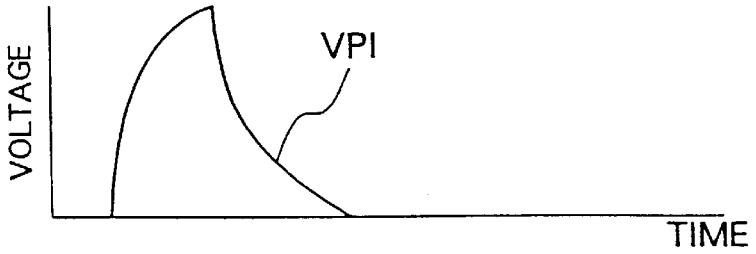

FIGS. 18A to 18C respectively show signal waveforms showing the voltages VG, VS and VPI, and FIG. 14D shows luminance variations with and without the capacitance 92, wherein LA shows the luminance variation with the capacitance 92 while the EL element 91 emits light due to the voltage VPI, and LB shows the luminance variation without the capacitance 92.

In FIG. 17, when the scanning line 93 is selected to feed the signal to turn on the TFT 90, the voltage is applied from the data line 94 to the EL element 91 and the capacitance 92. Accordingly, the EL element 91 is activated to emit light, and simultaneously, the capacitance 92 is charged.

On the other hand, when the scanning line turns into a non-selected state so that the signal is not fed to the TFT 90, the TFT 90 turns off so that the voltage on the data line 94 is not applied to the EL element 91. However, since the capacitance 92 is charged, the EL element 91 continues to emit light for a while due to the discharging by the capacitance 92.

Figure 18D:
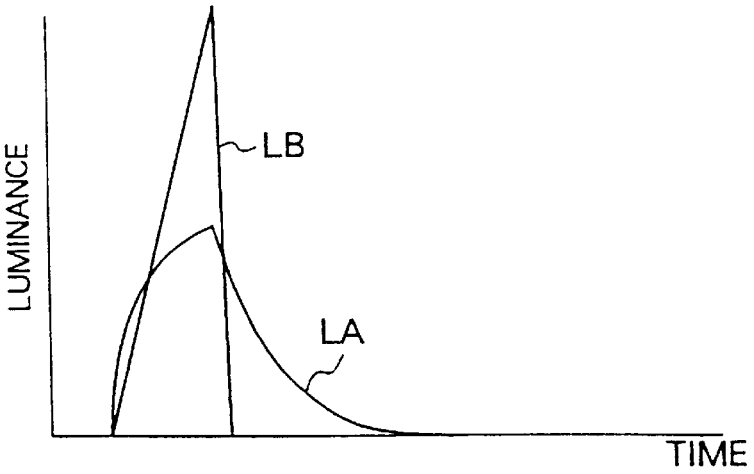
FIG. 18D is a diagram showing luminance variations with and without a capacitance connected in parallel to a light-emitting element.

Accordingly, as seen from LA in FIG. 14D, due to the charging and discharging operations of the capacitance 92, the luminance gradually increases and decreases and the maximum luminance is effectively suppressed, as compared with LB in FIG. 18D. Thus in case of LB since a luminance change is large and quick, when the number of the pixels is increased, flickering becomes notable. On the other hand, in case of LA, since a luminance change is small and gradual, flickering is effectively suppressed.

In this embodiment, the terminals of the light-emitting element and the capacitance are connected to the adjacent scanning line, not to the common electrode as in the foregoing third embodiment. Accordingly, the common electrode can be omitted, and in addition, problems caused by disconnection, short circuit or the like can be suppressed to improve reliability.

In this embodiment, the light from the light-emitting element is guided out from an upper side relative to the substrate. However, the present invention is not limited thereto. For example, it may be arranged that the electrode near the substrate is formed of a transparent material, such as, ITO, so as to guide out the light from a side where such a transparent electrode is formed.

Further, in this embodiment, the transistor is the amorphous silicon thin-film field-effect transistor of a reverse-stagger type. However, the transistor may be polycrystalline or monocrystalline silicon, compound semiconductor, such as, CdSe, or the like.

Now, referring to FIG. 19, a fifth embodiment of the present invention will be described hereinbelow.

Figure 19:
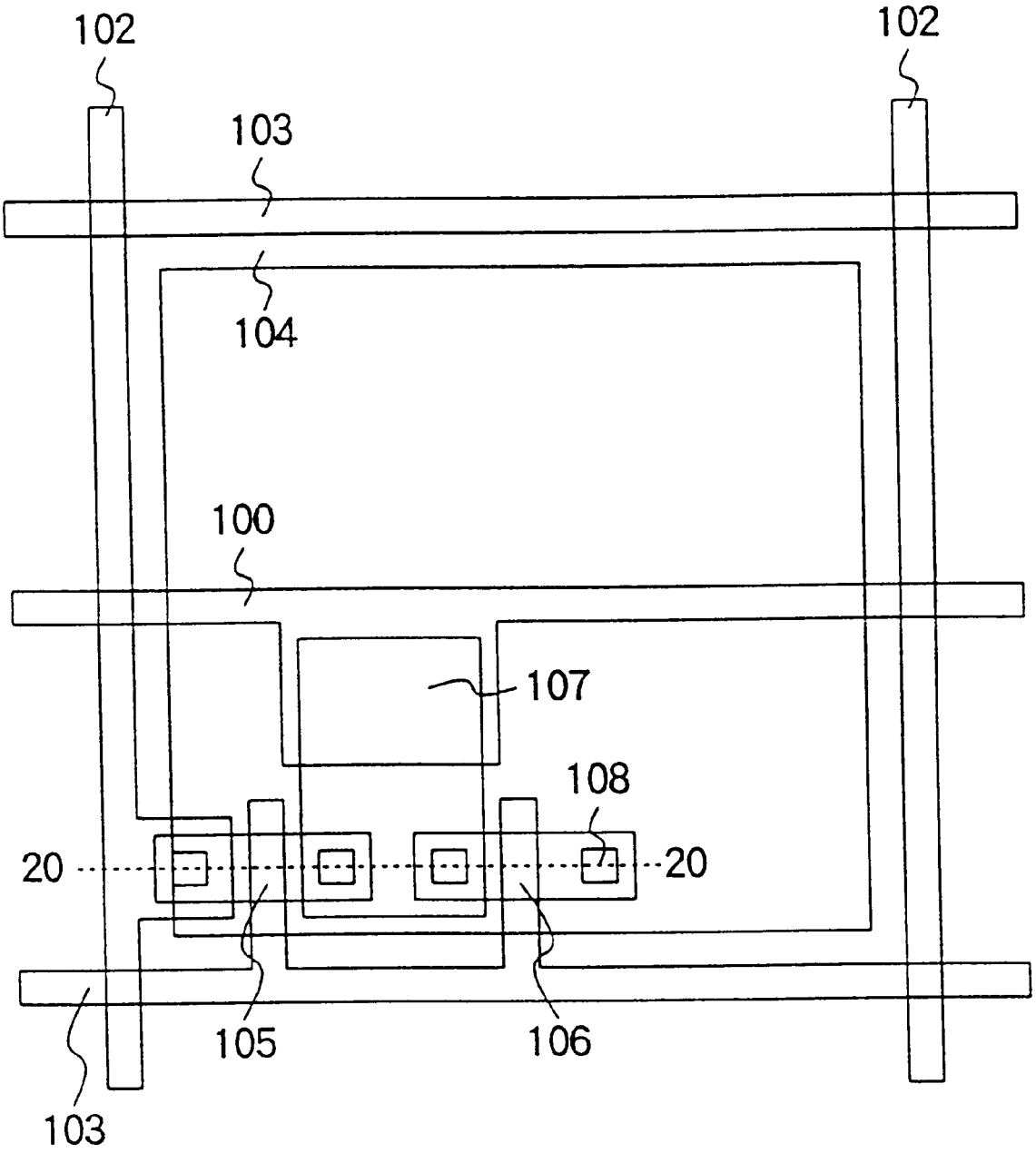
FIG. 19 is a plan view showing a structure of a fourth embodiment of the present invention.

FIG. 19 is a plan view showing an active matrix drive circuit according to the fifth embodiment of the present invention. In FIG. 19, numeral 103 denotes a scanning line, numeral 102 a data line, numeral 100 a capacitance line, numeral 105 a polysilicon thin-film n-channel field-effect transistor of a stagger structure (hereinafter referred to as "n-channel TFT"), numeral 106 be polysilicon thin-film p-channel field-effect transistor of a stagger structure (hereinafter referred to as "p-channel TFT"), numeral 107 a capacitance electrode, and numeral 108 a contact hole.

Figure 20:
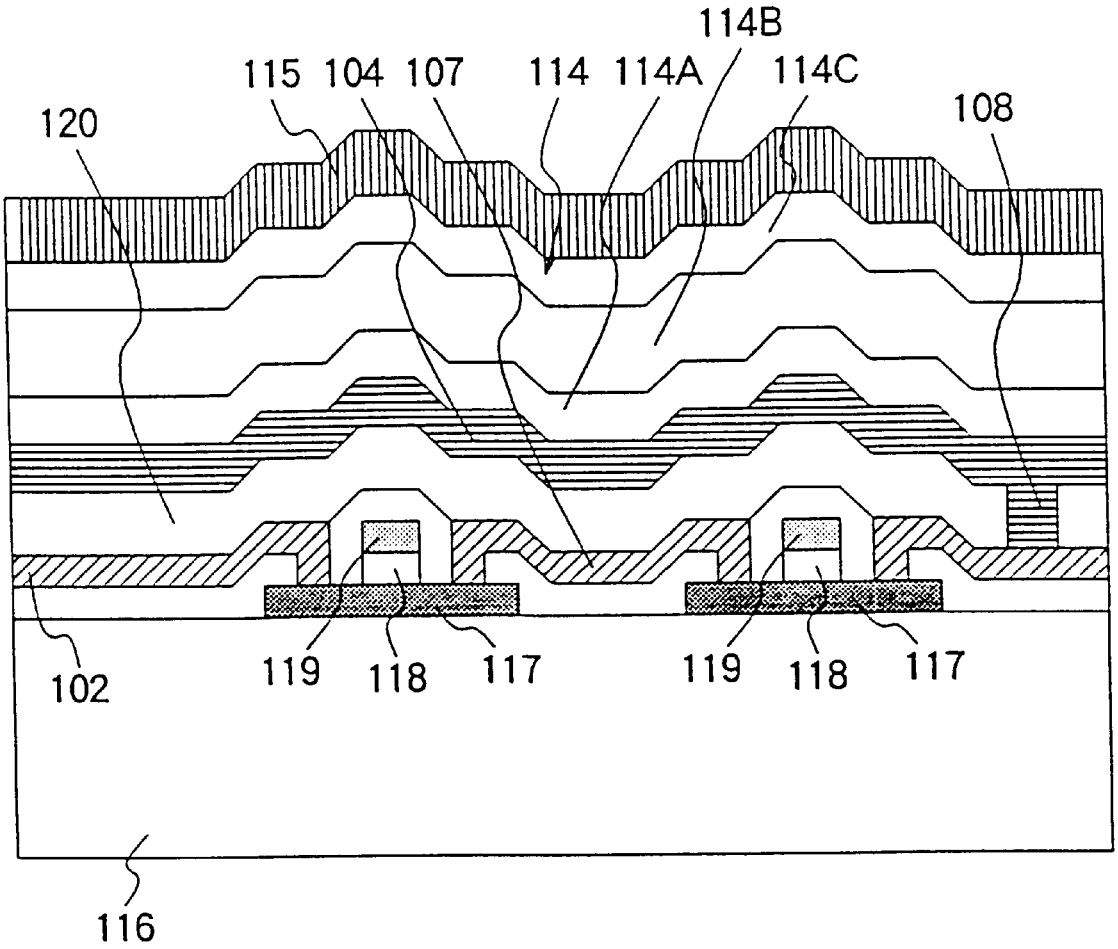
FIG. 20 is a sectional view taken along line 20—20 in FIG. 19.

FIG. 20 is a sectional view taken along line 20—20 in FIG. 19. In FIG. 20, numeral 116 denotes a transparent quartz substrate, numeral 117 an island, numeral 118 a gate oxide film numeral 119 a gate electrode, numeral 107 a capacitance electrode, numeral 102 a data line, numeral 104 an electron-injection electrode formed of MgAg, numeral 108 a contact hole, numeral 114 organic thin-film layers composed of a spacer layer 114A, an organic luminescent layer 114B and a hole-injection layer 114C and forming an organic thin-film EL element of a charge-injection type as a light-emitting element, numeral 115 a hole-injection electrode formed of ITO for guiding out light, and numeral 120 a layer insulating film.

Hereinbelow, a process for fabricating a display for a personal computer according to this embodiment will be described with reference to FIG. 20.

First, a polysilicon layer is deposited on the quartz substrate 116 to a thickness of 100 nm, and then the island 117 are pattern-formed.

Subsequently, an $SiO_2$ layer of 100 nm in thickness for the gate oxide films 118 and a layer of polysilicon of 300 nm in thickness for the gate electrodes 119 and the scanning lines are formed in a continuous manner, and then the gate oxide films 118, the gate electrodes 119 and the scanning lines are pattern-formed.

Thereafter, portions of the islands 117 of each of the n-channel TFTs 105 are removed and masked so as to inject P-ions. Subsequently, portions of the islands 117 of each of the p-channel TFTs 106 are removed and masked so as to inject B-ions.

Thereafter, a layer of $SiO_2$ of 500 nm in thickness is formed, then the contact holes are pattern-formed and the layer insulating films 120 are formed for separating the gate, source and drain electrodes. Subsequently, a layer of A1 of 500 nm in thickness is formed, and the source electrodes, the drain electrodes and the capacitance electrodes are pattern-formed.

Subsequently, a layer of $SiO_2$ for the light-emitting insulating films is deposited to a thickness of 200 nm, and the contact holes 108 are formed by etching for connection between the drain electrodes of the p-channel TFTs 106 and the late-formed electron-injection electrodes each being one of the electrodes of each of the EL elements.

Thereafter, a layer of MgAg is deposited to a thickness of 200 nm, and then the electron-injection electrodes 104 are pattern-formed by the lift-off method.

In this manner, a TFT panel for 640 pixels in row and 480 pixels in column with each pixel having a size of 200×200 $mm^2$ is prepared.

Thereafter, the organic thin-film EL elements are formed on the TFT panel.

In this embodiment, each EL element has the organic thin-film layers in a three-layered structure including, from the side of the electron-injection electrode 104, the spacer layer 114A for preventing dissociation of excitons on the surface of the electrode 104, the organic luminescent layer 114B and the hole-injection layer 114C which are stacked in the order named. First, a layer of tris (8-hydroxyquinoline) aluminum of 50 nm in thickness is formed as the spacer layer 114A, using the method of vacuum deposition. Then, as the organic luminescent layer 114B, a layer of tris (8-hydroxyquinoline) aluminum of 70 nm in thickness and a layer of 3, 9-perylene dicarboxylic acid diphenylester of 70 nm in thickness are formed by the method of co-deposition from the separate evaporation sources. Further, as the hole-injection layer 114C, a layer of 1, 1-bis-(4-N, N-ditolylaminophenyl) cyclohexane of 50 nm in thickness is formed using the method of vacuum deposition. Finally, as the hole-injection electrode 115, a layer of ITO, i.e. a transparent electrode material, of 1 mm in thickness is formed by the application method.

Now, a relationship of voltages applied to the lines and components in the drive circuit having the structure shown in FIGS. 19 and 20 will be described hereinbelow.

Figure 21:
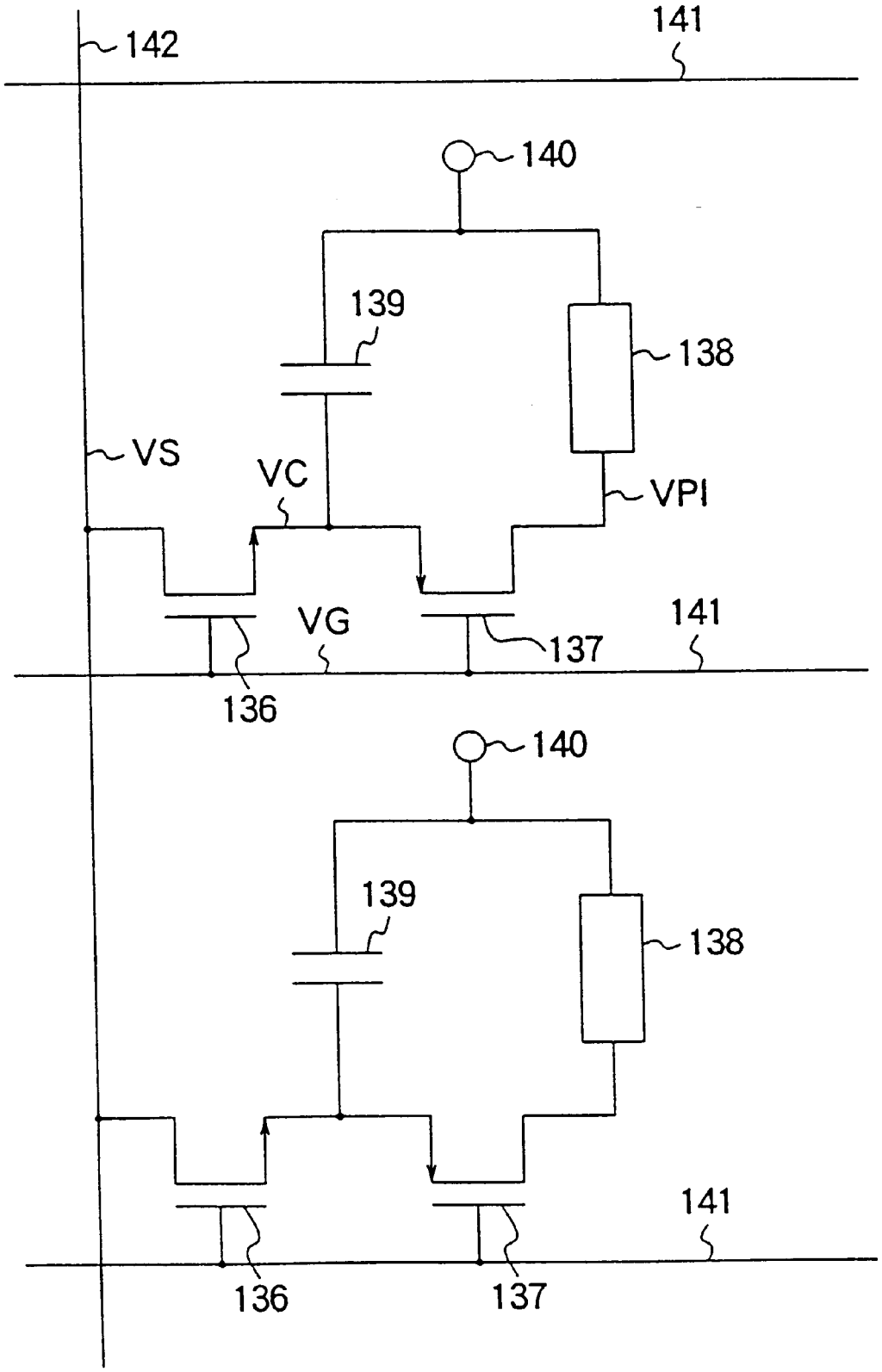
FIG. 21 is a diagram showing an equivalent circuit of the structure shown in FIGS. 19 and 20.

FIG. 21 is a diagram showing an equivalent circuit of the drive circuit shown in FIGS. 19 and 20. In FIG. 21, numeral 136 denotes an n-channel TFT, numeral 137 a p-channel TFT, numeral 138 an organic thin-film EL element, numeral 139 a capacitance connected in parallel to the EL element 138, numeral 140 a source electrode for supplying the current to the EL element 138 and the capacitance 139, numeral 141 a scanning line for feeding a signal to turn on the n-channel TFT 136 when the line is selected, and numeral 142 a data line for supplying the current to the capacitance 139 via the n-channel TFT 136 when it is on.

As shown in FIG. 21, the scanning line 141 is connected to the gate electrodes of the n-channel TFT 136 and the p-channel TFT 137. The data line 142 is connected to an electrode at one side of the n-channel TFT 136, and an electrode at the other side of the n-channel TFT 136 is connected to a junction between a terminal at one side of the capacitance 139 and an electrode at one side of the p-channel TFT 137. An electrode at the other side of the p-channel TFT 137 is connected to an electrode at one side of the EL element 138. A terminal at the other side of the capacitance 139 and an electrode at the other side of the EL element 138 are commonly connected to the source electrode 140.

FIG. 21, VG, VS, VC and VPI represent voltages on those points in the circuit. Specifically, VG represents a voltage on the scanning line 141, VS represents a voltage in the data line 142, VC represents a voltage on the electrode of the capacitance 139 connected to the n-channel TFT 136, and VPI represents a voltage on the electrode of the EL element 138 connected to the p-channel TFT 137.

Figure 22A:
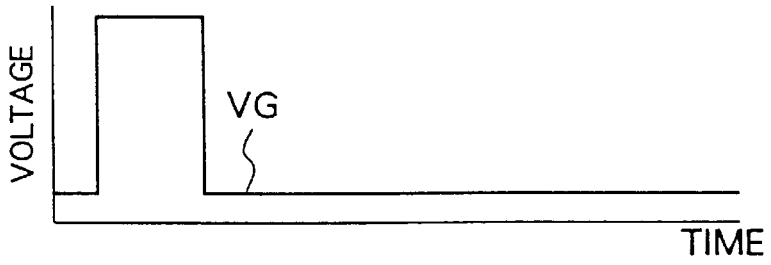
FIGS. 22A to 22C are diagrams, respectively, showing signal waveforms representing voltages on selected points in the circuit of FIG. 21.
Figure 22B:
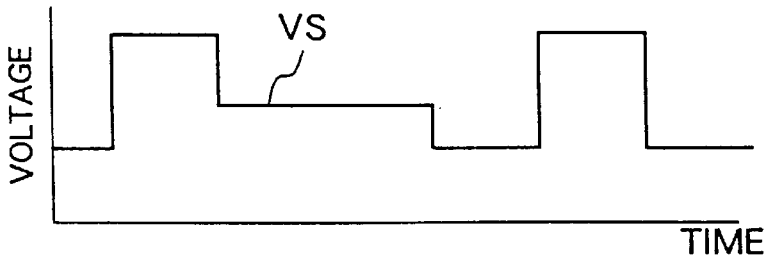
Figure 22C:
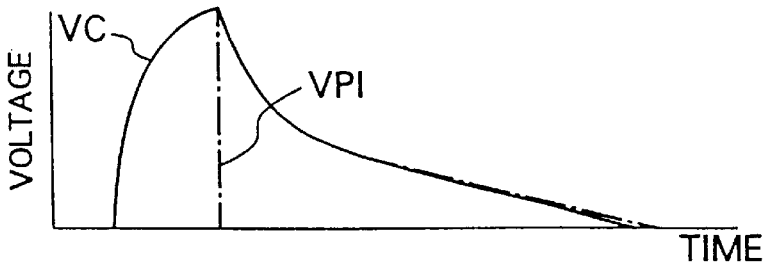
Figure 22D:
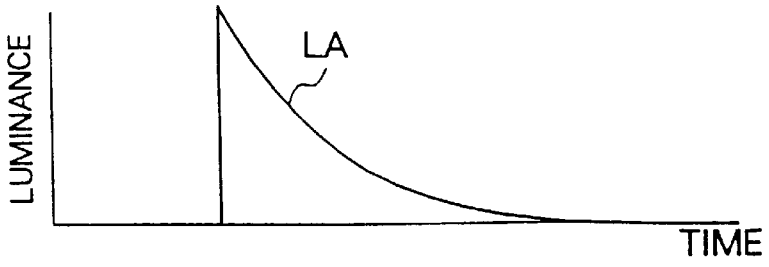
FIG. 22D is a diagram showing a luminance variation with a capacitance connected in parallel to a light-emitting element.

FIGS. 22A to 22C respectively show signal waveforms showing the voltages VG, VS, VC and VPI, and FIG. 22D shows a luminance variation LA while the EL element 138 emits light due to the voltage VPI. In FIG. 21, when the scanning line 141 is selected, the n-channel TFT 136 turns on so that the voltage is applied from the data line 142 to the capacitance 139 via the n-channel TFT 136. At this time, the p-channel TFT 137 is held off so that the EL element 138 does not emit light.

On the other hand, when the scanning line 141 turns into the non-selected state, the n-channel TFT 136 turns off so that the voltage on the data line 142 is not applied to the capacitance 139. However, since the p-channel TFT 137 turns on, the charges stored at the capacitance 139 are discharged into the EL element 138 via the p-channel TFT 137 to cause the EL element 138 to emit the light.

Since the charges stored by the capacitance 39 are discharged gradually, the EL element 138 continues to emit the light for a while.

In this embodiment, since the light-emitting element is not connected to the data line while the scanning line is selected, the on-transistor is required to supply the current only to the capacitance so that the transistor can be reduced in size.

In this embodiment, the light from the light-emitting element is guided out from an upper side relative to the substrate. However the present invention is not limited thereto. For example, it may be arranged that the electrode near the substrate is formed of a transparent material, such as, ITO , so as to guide out the light from a side where such a transparent electrode is formed.

Further, in this embodiment, the transistor is the polysilicon thin-film field-effect transistor of a stagger type. However, the transistor may be monocrystalline silicon.

What is claimed is:

1. A current-dependent light-emitting element drive circuit for use in an active matrix display device having a plurality of first lines extending in parallel with one another and a plurality of second lines extending perpendicular to said first lines to form a plurality of cross points arranged in a matrix form, said current-dependent light-emitting element drive circuit being connected to one of said first lines and one of said second lines at each of said cross points to form a pixel in the display device, said current-dependent light-emitting element drive circuit comprising:

a current-dependent light-emitting element having a first terminal connected to an external current supply means and a second terminal;

current control means coupled to said first and said second lines and connected to said second terminal of said current-dependent light-emitting element for controlling current flowing through said current-dependent light-emitting element from said current supply means in response to selection signals selectively applied to said first and said second lines; and a capacitor connected in parallel with said current-dependent light-emitting element.

2. A current-dependent light-emitting element drive circuit for use in an active matrix display device having a plurality of first lines extending in parallel with one another and a plurality of second lines extending perpendicular to said lines to form a plurality of cross points arranged in a matrix form, said current-dependent light-emitting element drive circuit being connected to one of said first lines and one of said second lines at each of said cross points to form a pixel in the display device, said current-dependent light-emitting element device circuit comprising:

a current-dependent light-emitting element having a first terminal connected to an external current supply means and a second terminal;

a capacitor having a first capacitor terminal connected to said first terminal of said current-dependent light-emitting element, said capacitor having a second terminal;

first current control means coupled to said first and said second lines and connected to said second capacitor terminal for controlling current flowing through said capacitor from said current supply means in response to selection signals selectively applied to said first and said second lines; and second current control means coupled to said second line and connected between said second capacitor terminal and said second terminal of said current-dependent light-emitting element, for supplying a current from said capacitor to said current-dependent light-emitting element, when said second current control means is turned on in absence of said selection signal.

3. An active matrix display device comprising:

a plurality of first lines extending in parallel with one another;

a plurality of second lines extending perpendicular to said first lines to form a plurality of cross points arranged in a matrix form; and a plurality of current-dependent light-emitting element drive circuits, each disposed to one of said cross points and being connected to one of said first lines and one of said second lines at each of said cross points to form a pixel in the display device, each of said current-dependent light-emitting element drive circuit comprising:

a current-dependent light-emitting element having a first terminal connected to an external current supply means and a second terminal;

current control means coupled to said first and said second lines and connected to said second terminal of said current-dependent light-emitting element for controlling current flowing through said current-dependent light-emitting element from said current supply means in response to selection signals selectively applied to said first and said second lines; and a capacitor connected in parallel with said current-dependent light-emitting element.

4. An active matrix display device comprising:

a plurality of first lines extending in parallel with one another;

a plurality of second lines extending perpendicular to said first lines to form a plurality of cross points arranged in a matrix form; and a plurality of current-dependent light-emitting element drive circuits disposed at cross points, each being connected to one of said first lines and one of said second lines at each of said cross points to form a pixel in the display device, said current-dependent light-emitting element drive circuit comprising:

a current-dependent light-emitting element having a first terminal connected to an external current supply means and a second terminal;

a capacitor having a first capacitor terminal connected to said first terminal of said current-dependent light-emitting element, said capacitor having an opposite second terminal;

first current control means coupled to said first and said second lines and connected to said second capacitor terminal for controlling current flowing through said capacitor from said current supply means in response to selection signals selectively applied to said first and said second lines; and second current control means coupled to said second line and connected between said second capacitor terminal and said second terminal of said current-dependent light-emitting element, for supplying a current from said capacitor to said current-dependent light-emitting element, when said second current control is turned on in absence of said selection signal.

* * * * *